United States Patent [19]

Koller et al.

[11] 4,410,015

[45] Oct. 18, 1983

[54] METHOD AND APPARATUS FOR PRODUCING AN INTERWOVEN SEAM INTERCONNECTING TWO WOVEN WEB PORTIONS

[75] Inventors: Rudolf Koller; Walter Runkel, both of Aachen, Fed. Rep. of Germany

[73] Assignee: Herrmann Wangner GmbH & Co KG, Reutlingen, Fed. Rep. of Germany

[21] Appl. No.: 277,217

[22] Filed: Jun. 25, 1981

[30] Foreign Application Priority Data

Jul. 9, 1980 [DE] Fed. Rep. of Germany ..... 3025909

[51] Int. Cl.[3] ..... D03D 41/00; D21F 1/12; D21F 7/10

[52] U.S. Cl. ..... 139/383 A; 139/11; 139/28; 28/141; 156/502; 245/10

[58] Field of Search ..... 139/383 AA, 383 A, 425 A, 139/11, 28; 28/141, 142; 162/DIG. 1; 24/38; 245/10; 156/502

[56] References Cited

FOREIGN PATENT DOCUMENTS

| | | | |
|---|---|---|---|
| 15246 | 9/1980 | European Pat. Off. | 156/502 |
| R 11073 | 6/1956 | Fed. Rep. of Germany | 139/383 AA |
| 1710205 | 9/1971 | Fed. Rep. of Germany | 139/383 AA |
| 47-43762 | 11/1972 | Japan | 139/383 AA |
| 763492 | 9/1980 | U.S.S.R. | 139/28 |

*Primary Examiner*—James Kee Chi
*Attorney, Agent, or Firm*—Michael J. Striker

[57] ABSTRACT

The end portions to be connected are arranged opposite one another, after at least some of the web weft threads have been removed therefrom to form a tying strip interconnecting the ends of the web warp threads in their original order. The web warp threads are gradually released from the tying strip, spatially separated, on an individual basis and in their original order, from the following web warp threads and delivered to the entrance of the then open seam loom shed formed in seam warp threads positioned intermediate the points of emergence of the web warp threads out of the original web. Thereafter, the separated threads are caused to traverse, as seam weft threads, the respectively associated seam shed produced by a Jacquard seam loom, this traversing movement being accomplished by a clamping arrangement arranged at the free end of a floating arm. A seam loom slay of a needle arrangement shifts the introduced seam weft thread into its proper position in the seam and the respective seam loom shed is then closed to detain the seam weft thread in this position. The separator may include a plurality of alternating thicker and thinner, smaller and larger, disks which form an arcuate helical groove at the periphery of the separator, or it may include a plurality of radially extending needles.

16 Claims, 31 Drawing Figures

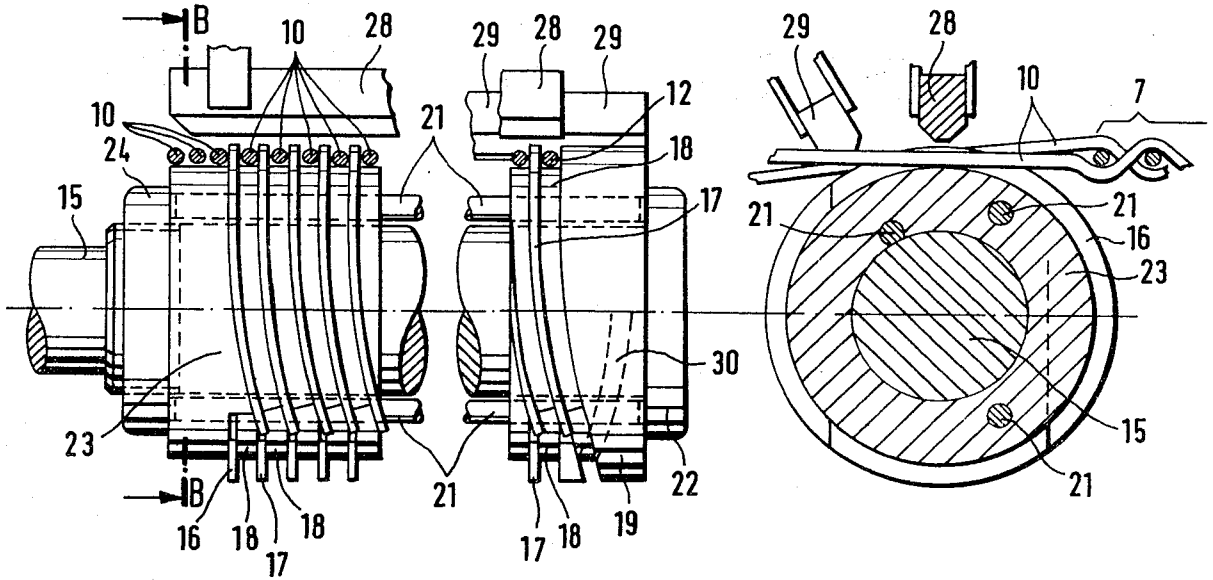
FIG. 4
FIG. 5
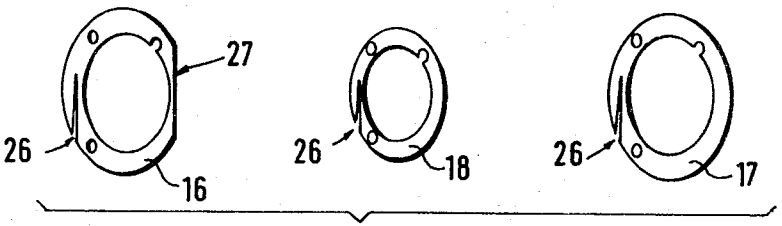
FIG. 6

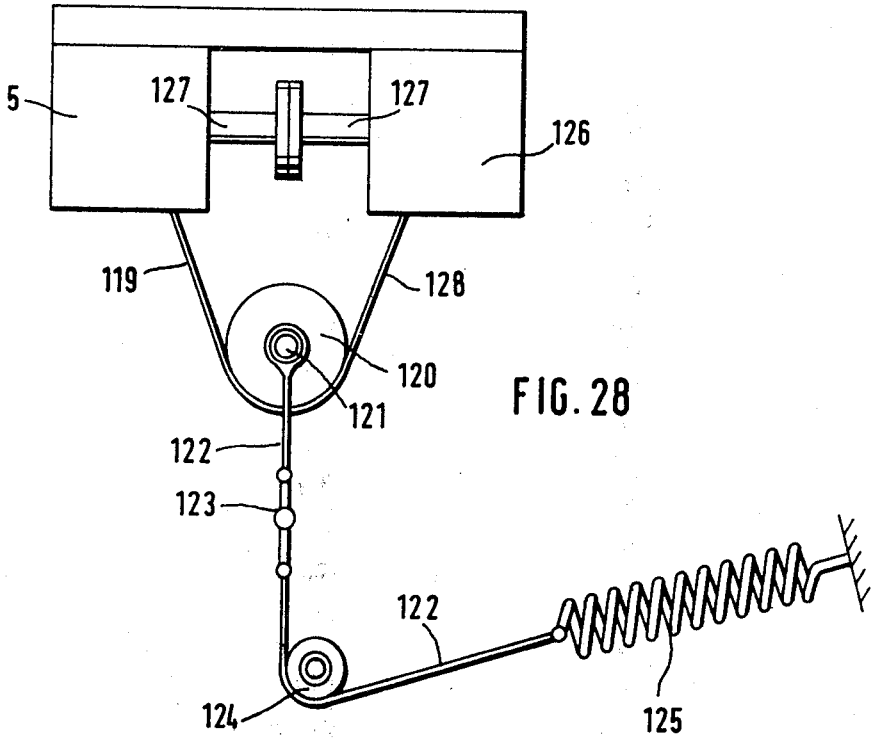
FIG. 28
FIG. 29
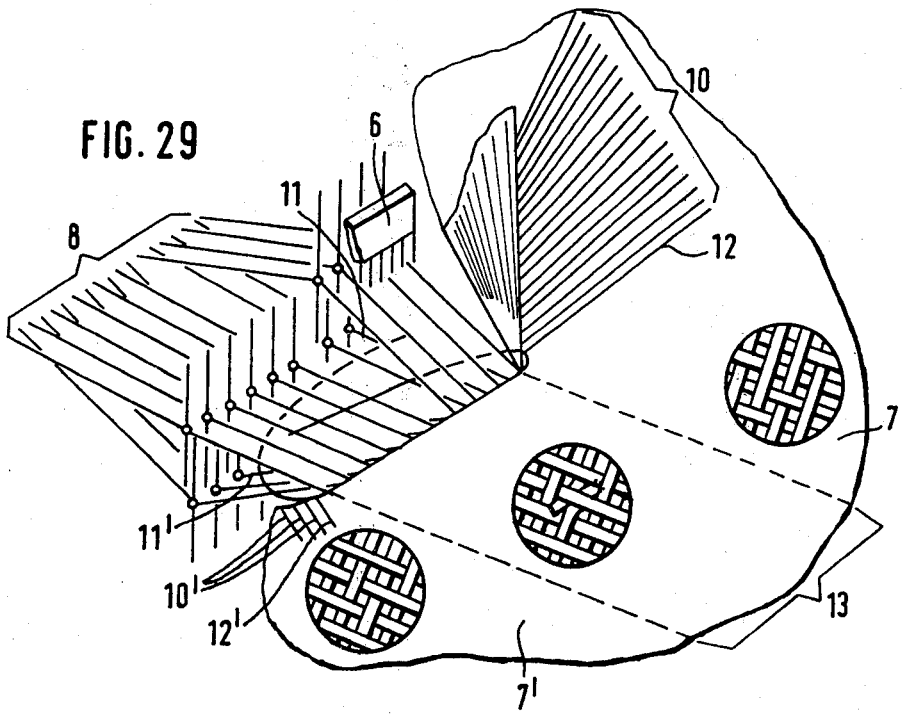

METHOD AND APPARATUS FOR PRODUCING AN INTERWOVEN SEAM INTERCONNECTING TWO WOVEN WEB PORTIONS

BACKGROUND OF THE INVENTION

The present invention relates to a method of producing an interwoven seam interconnecting two portions of a woven structure, especially for the purpose of making an endless woven band for use, for instance, in the paper-making industry. The invention is further related to an apparatus for performing the above-mentioned method.

Upto now, the production of such interwoven seams was accomplished exclusively manually in such a manner that the ends to be interconnected were frayed, that is, the transversely extending or web weft threads were removed therefrom, to the depth of about 100 to 200 millimeters and over the entire width of the web, and then the weft threads of the one end portion were woven into the other end portion at the warp threads thereof.

Inasmuch as the distance between the individual threads is, in many instances, very small, many times smaller than 100 micrometers, the manual weaving of the seam threads is a very laborious and time-consuming operation. It is especially difficult for the seam weaver to make sure that the next thread gripped by him or her is indeed the thread which comes next in the order of the threads of the respective array. Thread by thread, he or she must make sure that indeed the correct thread of the respective array has been taken out of this array. Should it, for instance, happen that the thread which should have waited for its turn one more time is mistakenly taken out of the respective array and interwoven with the threads of the other array instead of the next thread of the first-mentioned array, there is obtained a so-called crossing fault which makes the entire woven structure worthless and which must be removed in a laborious repair operation. Experience with this manual seam weaving operation has shown that many manhours are lost in the required reweaving and fault-removal operations.

The entire manual operation in interweaving the threads into a woven seam in an 8-meter wide woven web consisting of 0.18 millimeter threads (35 threads per centimeter) consumes, on the average, about 600 manhours. To this, there is to be added the fact that this seam weaving procedure requires a careful and lengthy education (the time of apprenticeship covering a 2-year period) and can be accomplished only by persons who are very handy and posses a high degree of finger dexterity. The seam weaving operation as such requires a high degree of concentration on the part of the weavers and, in addition thereto, it has a detrimental influence on the eyesight and on the general health of the seam weavers. A particular problem in this connection is the necessarily bad posture during the seam weaving operation. Back pains and intervertebral disk problems, consequently, belong to the working day problems of seam weavers.

Because of the special requirements and the long apprenticeship which, in reality, extends far into the actual seam weaving work in most cases, the circle of skilled seam weavers is quite small and exclusive. This is further aggravated by the fact that many apprentices give up this vocation during their apprenticeship, for health or other reasons, and many already working seam weavers give up after having worked in this field for a certain period of time. Owing to these factors, the renumeration of the seam weavers is higher, actually substantially higher, than the general level of wages of skilled workers employed in the web weaving field.

It will be appreciated from this explanation that the cost of the woven structures, such as endless bands, produced in this manual manner and incorporating the manually woven seams is extraordinarily high. Because of the high cost of such woven bands, the paper-manufacturing industry, for example, cannot be expected to store a wide variety or a great number of such endless bands. An additional reason for this reluctance in the paper-manufacturing industry to acquire a substantial stock of such endless webs or bands is that the band length, texture, mesh size and other parameters of the endless band often change from one run to another. On the other hand, the endless band manufacturing industry is incapable of delivering endless bands with the required parameters on short notice, at least in many instances. Furthermore, the special educational and other personal requirements of the seam weavers, who cannot be readily replaced by other personnel, add to the already long delivery time of the endless bands caused by the laboriousness of the seam weaving operation itself. So, for instance, if a seam weaver is ill or on vacation, the seam weaving operation, of necessity, takes correspondingly longer.

For the paper-manufacturing industry, therefore, there is to be added to the pure cost consideration also the problem of the delivery time. Thus, should it happen that a new endless band of particular parameters is needed on short notice, it may be that an endless band having these parameters is not available for delivery within the available time. Consequently, the operation of the paper-manufacturing facility must then either be changed to the production of a different type of paper, or discontinued altogether until the new endless band becomes available, if such change in operation is not possible or not feasible.

It will be appreciated that, in view of the above-mentioned circumstances, many attempts have been already made to mechanize or automate the seam weaving operation; yet, all such previous attempts have been unsuccessful. Only for the tensioning of the woven web and for the formation of the seam loom sheds have there been presented arrangements by means of which the still necessary manual work has been facilitated. One such arrangement is described in an article by J. Haslmeyer appearing on pages 206 to 208 of the April 1972 issue of Textil-Praxis. However, even these conventional arrangements have the disadvantage that they are incapable of avoid the need for a considerable amount of manual work. Incidentally, the above-mentioned amount of manhours required for producing the seam has already taken into account the use of arrangements of this type.

SUMMARY OF THE INVENTION

Accordingly, it is a general object of the present invention to avoid the disadvantages of the prior art.

More particularly, it is an object of the invention to provide an apparatus capable of performing the previously manually accomplished operations in a mechanized or automated manner.

Still another object of the present invention is to develop a method of producing interwoven seams which can be performed by skilled textile personnel without special education and skill in the seam weaving operation.

It is yet another object of the invention to so construct the seam weaving apparatus as to be easily convertible from the production of a web having certain parameters to the production of another web with different parameters.

An additional object of the present invention is to so construct the apparatus of the type here under consideration as to reduce if not eliminate the health problems previously encountered in the manual seam weaving operation.

It is a concomitant object of the invention to devise a seam weaving method by means of which the occurence of crossing and other faults can be avoided, as well as apparatus for performing such a method.

In pursuance of these objects and others which will become apparent hereafter, one feature of the present invention resides in a method of producing an interwoven seam interconnecting two end portions of a woven structure including a first array of parallel (web warp) threads and a second array of parallel (web weft) threads interwoven with the first array threads at right angles thereto, particularly for making an endless woven band, especially for use in the paper-manufacturing industry, this method comprising the steps of tying the first array threads of each of the end portions to be interconnected in their original order in a tying formation spaced by a predetermined distance from the remainder of the woven structure, including removing at least some of the second array threads from each of the end portions such that the tying formation is disposed at the free ends of the first array threads and is connected to the remainder of the woven structure only by such first array threads; positioning the end portions in registry with one another such that the second array threads are coextensive and the first array threads substantially register with one another; positioning seam warp threads between the points at which the first array threads emerge from the remainder of the woven structure; gradually releasing the first array threads in their original order from the tying formation; mechanically separating one of the first array threads at a time from the following first array threads; forming a respective seam loom shed from the seam warp threads; mechanically introducing the released and separated first array thread as a seam weft thread into the respective seam loom shed and transporting such seam weft thread across the respective seam loom shed; shifting the respective seam weft thread within the seam loom shed into its proper position in the seam being formed; detaining the properly positioned respective seam weft thread in the seam, including forming a following seam loom shed; repeating the introducing, shifting and detaining steps with another seam weft thread stemming from the respectively other end portion such that the other seam weft thread is transported across the further seam loom shed in the opposite direction and that the respective and other seam weft threads partially overlap one another; and advancing the seam weaving operation by a step having a length corresponding to the spacing between the individual first array threads, in timed sequence with the operating steps of releasing, separating, introducing, shifting, detaining and repeating. The advancing step can be accomplished either in an intermittent fashion, or on a continuous basis. It is advantageous when a special needle roller is used instead of the conventional seam loom slay for shifting the threads into their proper positions. The retention of the original order of the first array threads with respect to one another can be achieved, for instance, by adhering, soldering or welding such first array threads to one another at their free ends. On the other hand, the tying formation can also utilize the original web weft (second array) threads to the extent that they are not removed, or even threads which are foreign to the woven web, that is, have never been incorporated therein prior to the commencement of the seam weaving operation or the formation of the tying strip of the like.

In an advantageous embodiment of the present invention, the respective seam weft thread which is then to be introduced into the respective seam loom shed is entrained by a three-dimensionally controlled air stream for joint travel therewith.

After each seam loom shed change, a severing arrangement which is directed toward the seam being formed can be moved into the respectively open seam loom shed and sever at least a part of the overlapping portion of at least one, but even of each, of the associated adjacent overlapping seam weft threads, either simultaneously or consecutively in the case where both seam weft threads are affected. The lifting of the seam warp threads can be accomplished in three stages (i.e. the seam warp threads are located in three different planes) so that there are simultaneously formed two seam loom sheds, and one seam weft thread is caused to traverse each of the seam loom sheds in a direction opposite to that of the respectively other seam weft thread.

Another concept of the present invention resides in an apparatus for producing an interwoven seam interconnecting two end portions of a woven structure including a first array of parallel threads and a second array of parallel threads interwoven with the first array threads at right angles thereto, particularly for making an endless woven band, especially for use in the paper-manufacturing industry, such an apparatus comprising means for positioning the end portions to be interconnected, from which at least some of the second array threads have been removed to form a tying formation tying the first array threads of each of the end portions in their original order at their free ends and at a predetermined distance from the remainder of the woven structure, in registry with one another such that the second array threads are coextensive and the first array threads substantially register with one another; means for positioning seam warp threads between the points at which the first array threads emerge from the remainder of the woven structure; means for gradually releasing the first array threads from the tying formation in their original order; means for forming a succession of seam loom sheds from the seam warp threads; means for separating in a mechanical manner one of the first array threads at a time from the following first array threads; means for mechanically introducing the released and separated first array threads associated with the respective end portions of the woven structure as respective seam wefts threads in opposite directions into, and for transporting such seam weft threads in such opposite directions across, the respectively associated seam loom sheds; means for shifting the respective seam weft threads within the respectively associated seam loom sheds into their proper positions in the seam being formed, in which positions they are detained upon closing of the respectively associated seam loom sheds, such that the associated ones of such seam weft threads partially overlap each other in pairs; and means for advancing the seam weaving operation by a step having a length corresponding to the spacing between the individual first array threads of the woven structure, in timed sequence with the operation of the releasing, separating, forming, introducing and shifting means.

The apparatus of the present invention advantageously includes two machine halves of a seam weaving arrangement, the two halves being identical except for being mirror images of one another, each of the machine halves including one set of the above-discussed means. The seam weaving arrangement further includes a Jacquard seam loom which has a plurality of ties at least some of which are connected to the seam warp threads. The seam weaving arrangement may include a frame interconnecting the two machine halves and shiftably mounted on a support forming a part of the positioning means for the woven web and for the seam warp threads. The separating means may include a helix-like separator consisting of an alternating succession of thicker and thinner disks which are mounted on a common rotatable shaft. In this separator, the thicker disks have a thickness corresponding to the diameter of the seam weft threads and the thinner disks have larger diameters than the thicker disks, the diameter difference being such as to be sufficient for the accomodation of the seam weft thread texture between the two adjacent thinner disks. The first disk is constructed as an inlet disk and the last disk as an outlet disk, as seen opposite to the advancement direction, and the thinner disks, as well as the thicker disks, are provided with lateral slots and the thus separated portions of such disks are bent out of the planes fo such disks, so that a helical groove is formed by such bent portions and by the remainders of the disks at the periphery of the separator having this construction. In a simplified construction, the separator has only one such thicker disk which is flanked by the inlet disk and by the outlet disk, and a collar provided with an external screw thread adjoins one of the inlet and outlet disks. However, it is also advantageous when the separating means includes means defining an aerodynamic air guiding channel, and an air jet nozzle issuing an air jet into the channel where it entrains the respective seam weft thread for joint travel through the air channel and toward the respective seam loom shed. When the structure of the woven web is more complicated, such as when the woven web has two layers, when the treads are metallic wires, and so on, the respective seam weft thread which is released from the tying formation is engaged by a needle separator which rotates in timed sequence with the operation of the other means and which is equipped with at least one separator needle which comes into contact with the respective seam weft thread and separates the same from the following seam weft threads.

In a particularly advantageous embodiment of the present invention, the seam weft thread which is then to be introduced into the seam being formed is engaged by a tubular floating arm which is mounted on a pivotally mounted two-arm rocking lever. The floating arm carries a seam weft thread clamping arrangement at its free end, this clamping arrangement including at least one steel wire which is bent at its free end portion which extends beyond the free end of the floating arm, the remainder of the steel wire being accommodated in the interior of the tubular floating arm. The steel wire is shiftable relative to the floating arm and is connected to the rocking lever, so that it clamps the respective seam weft thread at the free end of the floating arm with its bent portion and releases the seam weft thread after the same has been pulled by the floating arm through the respective seam loom shed and after the floating arm has been pivoted with the rocking lever.

The shifting of the respective seam weft thread into the nip of the then open seam loom shed is accomplished, in accordance with a currently preferred aspect of the present invention, by means of a needle roller which is rotatably mounted on the frame of the seam weaving arangement and which is rotated in a stepping or intermittent manner, for instance, by a stepping motor. Two rows of needles are provided on the outer periphery of the needle roller, such needles extending substantially radially outwardly of the needle roller. The needles are so arranged in the respective rows that the rows are arranged opposite one another across the needle roller and that one of the row forms a clockwise, and the other a counterclockwise, helix on the outer periphery of the needle roller. The shifting of the respective seam weft thread into the respective seam loom shed nip can, however, also be accomplished due to the action of substantially Z-shaped needles which are substantially rectangularly bent and which are arranged in a substantial parallelism with one another on a guide bed, one end of each of the Z-shaped needles being guided in a curved groove of a shifter which is movable in timed sequence with the other operations of the seam-weaving arrangement, while the other, bent end of each of the Z-shaped needles extends into the respective seam loom shed and performs a movement therewith which is determined by the curved shape of the curved groove of the shifter.

The novel features which are considered as characteristic of the invention are set forth in particular in the appended claims. The improved seam producing apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is a partial side elevational view of a disk separator of the machine of FIG. 1;

FIG. 5 is a sectional view taken on line B—B of FIG. 4;

FIG. 6 is an exploded view of a part of the separator of FIG. 4 showing an inlet disk at right, a thicker disk in the middle, and a thinner disk at left;

FIG. 28 is a diagrammatic view showing two cooperating Jacquard seam looms, a summation roller, and a tie connected to the axle of the summation roller, trained about a deflecting roller, and connected to a tensions spring mounted on the frame;

FIG. 29 is a diagram showing the principle of the double seam loom shed, in a diagrammatic and perspective manner;

DETAILED DESCRIPTION OF THE PREFERRED EMBODIMENT

Figure 1:
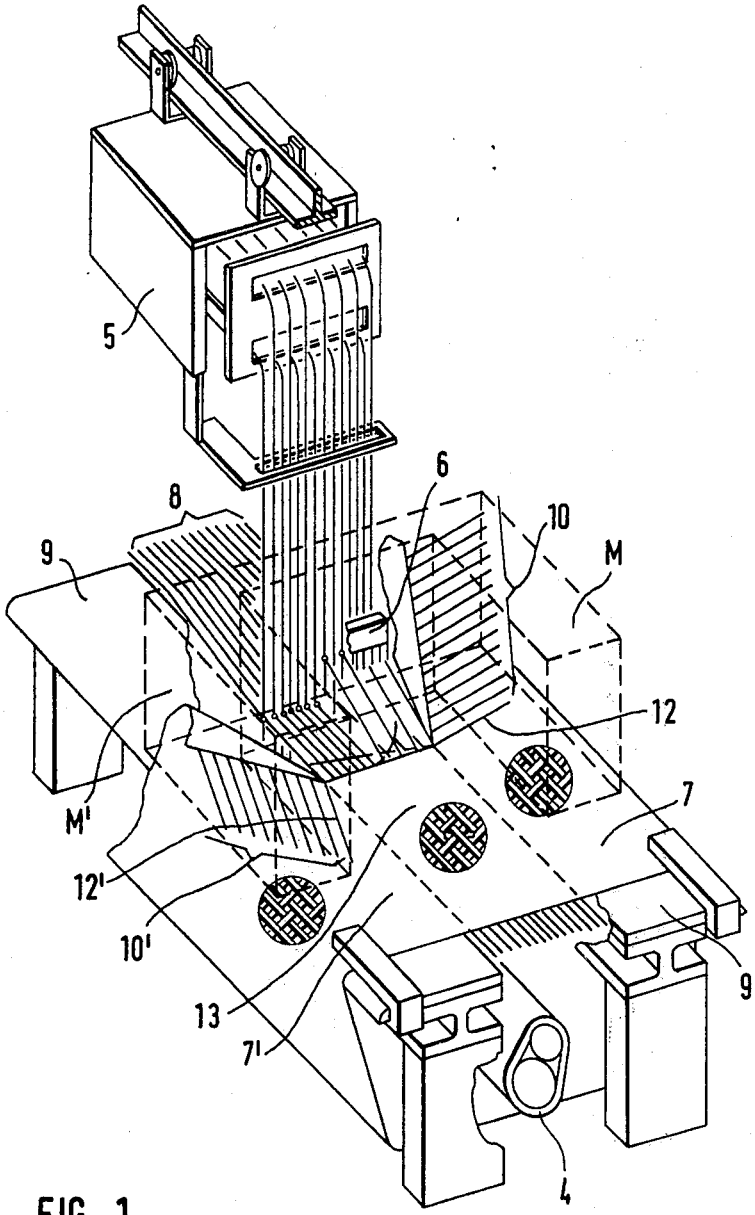
FIG. 1 is a partially diagrammatic perspective view of a seam weaving machine of the present invention.

Referring now to the drawing in detail, and first to FIG. 1 thereof, it may be seen therein that a seam weaving machine of the present invention includes two machine halves M and M' which are merely indicated in FIG. 1 in phantom lines in order not to unduly encumber the drawing and the details of which will become apparent as this description proceeds. Such machine halves M and M' are arranged opposite one another and are, except for being mirror images of each other, identical with one another. Because of the identical construction of the machine halves M and M', the same reference numerals have been used to identify their parts, except that the reference numerals for the parts of the machine half M' have been supplemented with a prime. Hence, any reference in the following description to a part identified by a reference numeral without a prime is equally applicable to the corresponding part identified by the same reference numeral supplemented with a prime, and vice versa, unless otherwise stated or apparent from the context.

Figure 2:
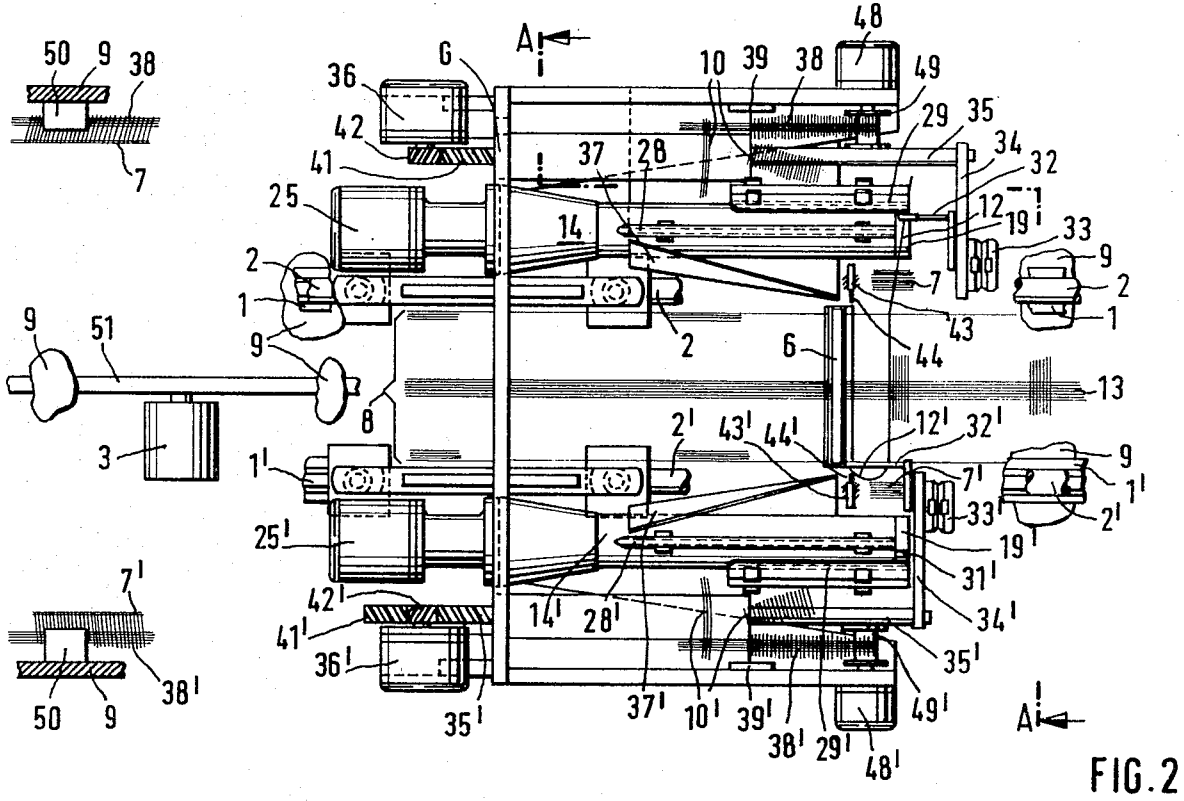
FIG. 2 is a partially diagrammatic top plan view of the machine of FIG. 1 but with a Jacquard seam loom omitted therefrom.

The two machine halves M and M' are connected to one another by a common frame G. As shown in FIG. 2, the frame G is mounted, by means of carrier prisms 1, on guide rails 2 for movement longitudinally of the latter. The common frame G can be moved by means of a motor 3, which may be a stepping motor or a continuously operating motor, from one end of a woven web or cloth bale 4 (see FIG. 1) to the other end thereof. Typically, the bale 4 has a length (corresponding to the width of the web) of, for instance, 4 to 8 meters. Throughout the specification, references are being made to a textile web or cloth, and to threads, but it is to be understood that these expressions are being used only in order to simplify the description and that the seam weaving machine of the present invention is equally well, if not better, suited for use with other types of woven materials, such as mesh webs, and with other types of elongated constituent elements other than threads, such as filaments, fibers, yarns, or even wires, whether of textile, synthetic plastic, metallic, or other materials.

A Jacquard loom 5 mounted on the frame G, and a loom slay 6 are associated with both of the machine halves M and M'. The ends of a woven web 7 which are to be joined with one another are clamped to the right and to the left of any array of clamped warp threads 8 of the seam (which extends parallel to the weft threads of the woven web 7) on a clamping arrangement 9. The frame G carrying the two machine halves M and M' and the Jacquard loom 5 is movably mounted on this clamping arrangement 9 in that the rails 2 form constituent parts of the latter. The web ends are clamped in such positions that the warp threads 10 of the woven web 7, which are to become the weft threads of the seam, are substantially aligned with one another in a one-to-one relationship. The Jacquard loom 5 is operative for sequentially forming consecutive loom sheds 11 of the seam 13 being woven. During the operation of the machine, that seam weft thread 12 the turn of which has come is introduced into the then existing loom shed 11 by means of the seam weaving machine M, M' of the present invention, then shifted by the loom slay 6 into the nip between the seam warp threads 8, and then arrested in position by the formation of the next following seam loom shed 11'. Into this newly formed seam loom shed 11', there is then introduced that seam weft thread 12' the turn of which has come by means, of the seam weaving machine M', M, whereupon the seam loom slay 6 shifts the seam weft thread 12' into the new nip between the seam warp threads 8 and finally the seam weft thread 12' is arrested in position as another seam loom shed 11 is formed. This succession of operating steps is repeated by alternatingly introducing the seam weft threads 12, 12' by means of the seam weaving machine M, M' into corresponding, alternatingly formed, seam loom sheds 11, 11', until the entire seam 13 is produced.

Figure 3:
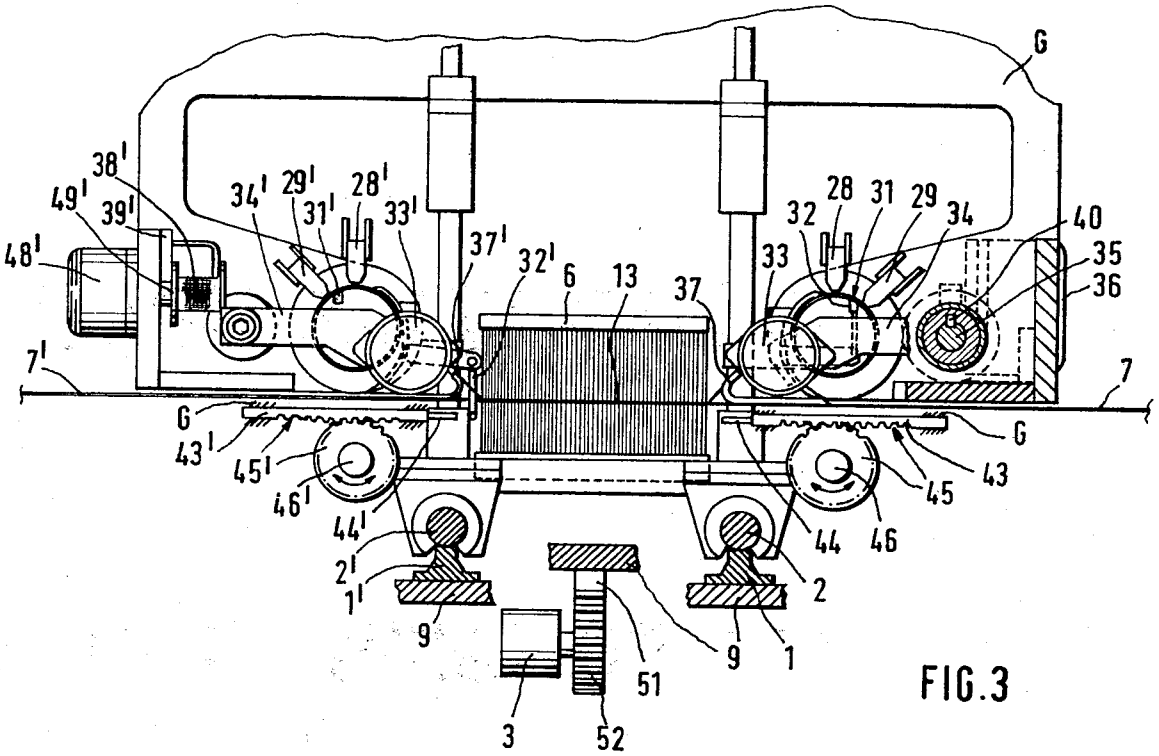
FIG. 3 is a sectional view taken on line A—A of FIG. 2.

The two machine halves M, M', which are shown in detail in FIGS. 2 and 3, are constructed symmetrically, as already mentioned before, and their plane of symmetry with respect to one another passes through the center of the seam 13. The seam weft threads 12, 12' are spatially separated in the seam weaving machine M, M' by means of disk separators 14. The operation is identical for the right and left half of the seam weaving machine M, M'.

As shown in detail in FIGS. 4 and 5, each disk separator 14, which is rotatably supported on the frame G, basically consists of a separator shaft 15, an inlet disk 16, a helix part 17, 18, and an outlet disk 19. The helix part 17, 18 consists of individual disks 17 and 18 of different thicknesses, wherein the thinner disks 17 have a larger diameter, and the thicker disks 18 have a smaller diameter. The thickness of the disks 18 is dependent on the thickness of the warp threads 10 of the woven web 7 which are to be handled by the separator 14 and separated thereby to become the individual weft threads 12 of the seam 13, and the thickness of the larger-diameter disks 17 is dependent on the distance of the web warp threads 10, which are to become the individual seam weft threads 12 following separation, from one another. The difference in the diameters of the thinner and thicker disks 17 and 18 must be such that the web warp threads 10, which have been textured during the web weaving operation, fit into the grooves of the helix constituted by the disks 17 and 18 without any distortion of the texture.

Figure 31:
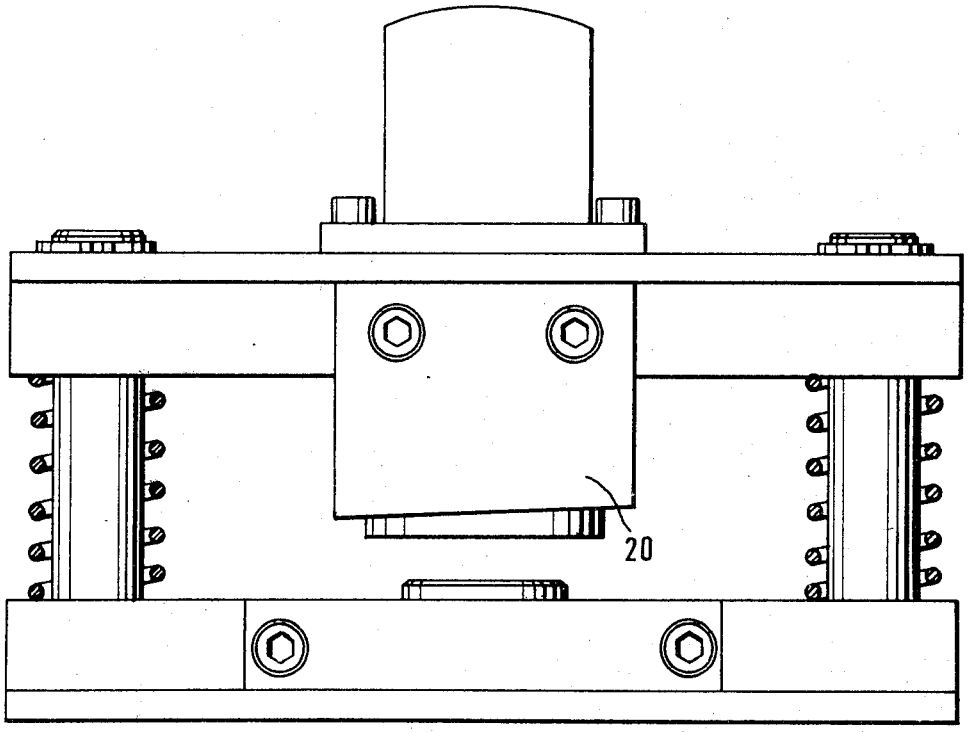
FIG. 31 is a front elevational view of a cutting and bending arrangement of the partial cutting into and bending of portions of the inlet disks, the thinner and thicker disks as shown in FIG. 6.

The helix-like formation 17, 18 is formed in that the individual disks 17 and 18 are partly cut into at their outer portions, and the thus partly dissociated regions are bent out of the plane of the respective disk 17 or 18 in the forward direction. This deformation of the disks 17 and 18 can be accomplished by a cutting and bending arrangement 20 which is shown in FIG. 31. In the course of assembly of the disks 16 to 19 with the separator shaft 15, there is, consequently, formed a helix in which an axial transportation of the web warp threads 10, which are individually drawn into the separator 14 by the inlet disk 16, occurs only in a predetermined range of rotation of the separator 14.

In order to form such a helix-like formation, the individual disks 16 to 19 must be positioned on the separator shaft 15 and additionally on guiding rods 21 in the following manner; initially, the outlet disk 19 is slid onto the separator shaft 15 and onto the guiding rod 21 until it comes to rest against a collar 22 of the separator shaft 15. Then, commencing with a thicker disk 18, the disks 18 and 17 are alternatingly slid onto the separator shaft 15 and onto the guiding rod 21, until the desired length of the helix-like formation 17, 18 is achieved. Finally, the inlet disk 16 is slid onto the separator shaft 15 and onto the guiding rods 21. After the individual disks 16 to 19 have been slid onto the separator shaft 15, they are clamped by means of a clamping ring 23 and a clamping nut 24 against the collar 22 of the separator shaft 15. The so formed helix-like formation 16 to 19 is operative for achieving the respectively desired axial transportation of the web warp threads 10 only in a predetermined range of rotational movement of the separator 14. One of the guiding rods 21 is provided with a flat at its circumferential surface, this flat resting against the separator shaft 15, as shown in FIG. 5. This expedient is being used in order to assure, under all circumstances, the same direction of pitch of the helix.

The clamping ring 23 and the outlet disk 19 are formed with respective recesses which open onto their axial faces facing the succession of disks 17, 18. The shape of such recesses is dependent on the pitch magnitude and direction of the thus formed helix and, consequently, it is again dependent on the diameter of the web warp threads 10 and on the direction of rotation of the disk separator 14.

During the operation of the machine, the disk separator 14 of the machine half M conducts a movement about its axis which is limited to 360° and then discontinued, in the clockwise direction, while the disk separator 14' of the machine half M' conducts the same movement, but in the counterclockwise direction, in each instance, as seen in the weaving direction. These movements, which are always temporarily discontinued after one complete revolution of the respective separator 14, 14', are caused by an intermittently operating stepping motor 25 which may be seen in FIG. 2. The respective pitch direction of the helix-like formation 16 to 19 of the disk separator 14 is achieved by the corresponding shaping of the recesses in the axial faces of the clamping ring 23 and of the outlet disk 19, as well as correspondingly cutting into and bending the outer portions of the disks 16, 17 and 18. The pitch direction of the recess on the outlet disk 19 corresponds to that of the remainder of the helix-like formation 16 to 18.

The individual drawing-in of the warp threads 10 of the web 7 into the disk separator 14 is achieved in that the inlet disk 16, which is provided with an incision 26 by the cutting and bending arrangement 20, is constructed exactly like the thin disks 17 of the helix-like formation 17, 18, with the only difference that, as shown in FIG. 6, a segment is severed and removed from the inlet disk 16 at a region thereof disposed opposite the incision 26, the line of severance extending substantially parallel to the incision 26, so that there is formed a sort of a cutting edge 27 at this region. This cutting edge 27 cooperates with a first, web warp thread, guide 28 for the inlet of the web warp threads 10, as well as with a second, seam weft thread, guide 29 for the individual outlet of the seam weft threads 12. Each of the guides 28 and 29 is constituted by a bar which includes a cutting edge directed toward the separator 14 and which is mounted for displacement toward and away from the separator 14 as well as in its longitudinal direction. The first guide bar 28 is longer than the second guide bar 29, in that the first guide bar 28 extends beyond the second guide bar 29 at the outlet end by a longitudinal distance which exactly corresponds to the width of the outlet disk 19. As a result of these expedients, as well as a result of the fact that the inlet disk 16 is situated at a predetermined distance from the first of the thinner disks 17 (i.e. of the disks having the larger diameter), it is achieved that only one of the web warp threads 10 can be drawn into the separator 14 during each complete (360°) revolution of the latter.

The outlet disk 19 which is disposed at the outlet end of the helix-like formation 16 to 18 is so configurated that it causes a spatial separation of the seam weft thread 12 which is then to be weaved into the seam 13 from the web warp threads 10 which follow the same and which are still situated in the grooves bounded in the helix-like formation 16 to 18 of the separator. This spatial separation occurs in the axial direction of the separator 14, and it is caused by a special groove 30 which is provided in the outlet disk 19 and which has a pitch substantially exceeding that of the helix-like formation 16 to 18. Furthermore, as seen in FIG. 3 and especially in FIG. 7, a depression 31 is formed in the circumferential surface of the outlet disk 19, which renders it possible for a gripper 32 (see FIGS. 2 and 3)

to grip the seam weft thread 12 then being released by the separator 14. As seen particularly well in FIG. 2, this gripper 32 is configurated as a crank which is being turned in synchronism with the progression of the seam weaving operation by a stepping motor 33. The stepping motor 33 is mounted on a cantilevered portion 34 of a guide rod 35 which is mounted on the frame G for longitudinal displacement and which is displaced, in synchronism with the progression of the seam weaving operation, in the weaving direction and back. The longitudinal displacement of the guide rod 35 is effectuated by means of a further stepping motor 36.

As a result of the combined turning and translation displacement of the gripper 32, the free end thereof moves along a spatial curve which extends between the outlet disk 19 of the separator 14 and the entrance of the respective seam loom shed 11.

A web guide 37 made of sheet metal is arranged at each of the machine halves M and M', by means of which the two ends of the web 7 are being held open in front of the seam 13 being formed in a funnel-shaped or conical fashion and thus are made ready for the separation of the web warp threads 10.

Figure 7:
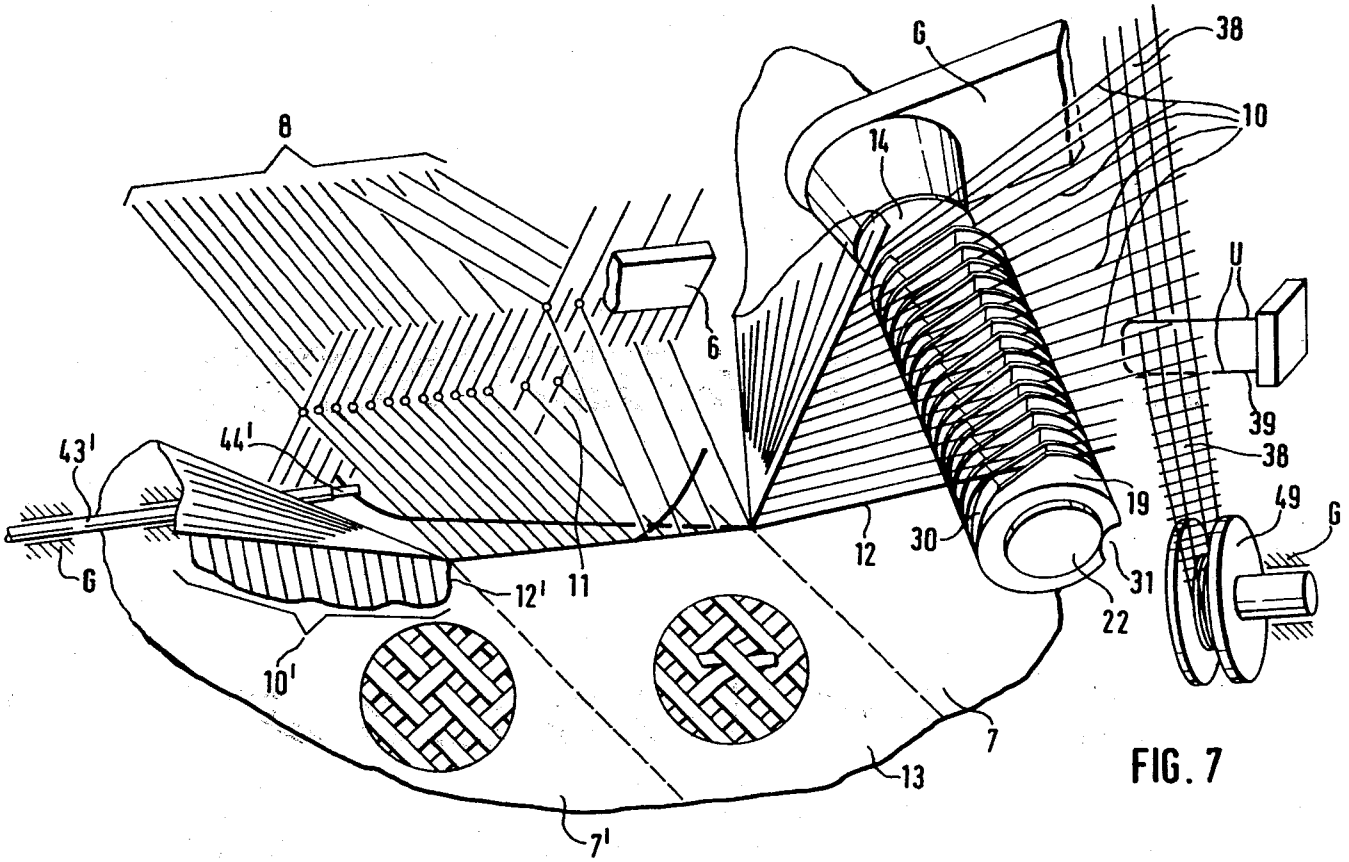
FIG. 7 is a diagrammatic perspective view of the disk separator of FIG. 4 as used.

As a result of the provision of the separator 14 which is rotatably mounted on the frame G, and of the web guide 37, it is achieved, as may be seen from FIG. 7, that the cutting edge 27 best seen in FIG. 6 comes into contact with an additional tying formation 38 (shown in FIG. 2 and also in FIG. 7) disposed at the free ends of the web warp threads 10, and holding the latter together. The tying formation 38 may have come into existence in that most but not all of the web weft threads of the respective end portion of the woven web 7 may have been removed from between the web warp threads 10 and the remaining web weft threads may have been left at or shifted to the free ends of the web warp threads 10. The cutting edge 27 of the inlet disk 16 contacts the tying formation 38 at the root thereof. As a result of the subsequent transportation of the web warp threads 10, which are being drawn into the separator by the inlet disk 16 on an individual basis, along the helix-like formation 16 to 18, of the action of the web guide 37, and the relative movement between the seam weaving machine M, M' and the woven web 7 as the seam weaving operation progresses, it is achieved that the root portions of the web warp threads 10, that is, those portions thereof which are closest to the intact woven web 7, move farther and farther away from the separator 14 as they are transported towards its output end. This is necessary in order to assure that the web warp threads 10, which have been liberated from the tying arrangement 38 which had originally connected them together at their free ends by the action of a thermal cutting arrangement shown in FIGS. 2, 3 and 7 that is rigidly connected to the frame G, can be again separated from one another by a combing-through action of the separator 14 after possibly becoming entangled with one another following their liberation from the tying arrangement 38. The construction of the thermal cutting arrangement 39 is commonly known in the web weaving field and, therefore, the details thereof need not and will not be discussed here.

The above-discussed procedure renders it possible that the seam weft threads 12 can be clamped by the respectively associated gripper 32 (shown in FIG. 2) at their free ends as they are individually presented or made available by the separator 14 at the outlet end of the latter. The grippers 32 are so guided along the above-mentioned spatial curve that the respective free end of the then available seam weft thread 12 which is being held in the respective gripper 32 moves past the disk separator 14 and the first seam weft thread guide 28 to the elevation of the respective seam loom shed 11.

Any turning of the guide rods 35 is prevented by means of keys 40. A respective toothed formation 41 is provided at the rear end of each of the guide rods 35. As a result of a controlled reversing rotational movement of the output shaft of the respective stepping motor 36, and as a result of the transmission of this rotational movement by respective gears 42 which mesh with the teeth of the respective toothed formations 41 of the guide rods 35, such guide rods 35 conduct a defined motion in the axial direction of the disk separators 14. The rotational movements of the output shafts of the stepping motors 33 and 36 are correlated to one another.

The free or forward end of the seam weft thread 12, which has been brought by means of the gripper 32 to the elevation of the respective seam loom shed 11 is now engaged and taken over by a seam weft thread clamping arrangement 44' which is mounted on a floating arm 43' that is mounted for displacement longitudinally thereof but prevented from turning about its axis to be pulled thereby through the seam loom shed 11. The floating arm 43' must be situated within the space which is formed by the woven web 7 the end portions of which are to be connected by the seam 13, inasmuch as the introduction of the floating arm into the seam loom shed 11 would not be possible for reasons of space availability. In the course of drawing the second seam weft thread 12' from the opposite machine half M' through the respective seam loom shed 11', the seam weft thread clamping arrangement 44 mounted on the floating arm 43 takes over the seam weft thread 12' from the gripper 32' and pulls such thread 12' through the seam loom shed 11'. When the seam weft clamping arrangements 44 are appropriately constructed, it is also possible to use the floating arm 43 to move the seam weft thread 12 only into the center of the seam loom shed 11, where the seam weft thread 12 is then taken over by the floating arm 43' which finishes the operation of drawing the seam weft thread 12 through the seam loom shed 11. The drawing of the seam weft thread 12' through the respective seam loom shed 12' is then conducted in the same manner but in the opposite succession.

Each of the floating arms 43 is provided with a toothed portion 45; the required straight-line oscillating motion of the respective floating arm 43 is accomplished via the toothed portion 45 thereof, in that the floating arms 43, as already mentioned before, are mounted on the frame G in a non-turnable manner but with freedom to move longitudinally thereof, and in that they are longitudinally moved by the action of stepping motors 46 which conduct reversing movements.

Figure 8:
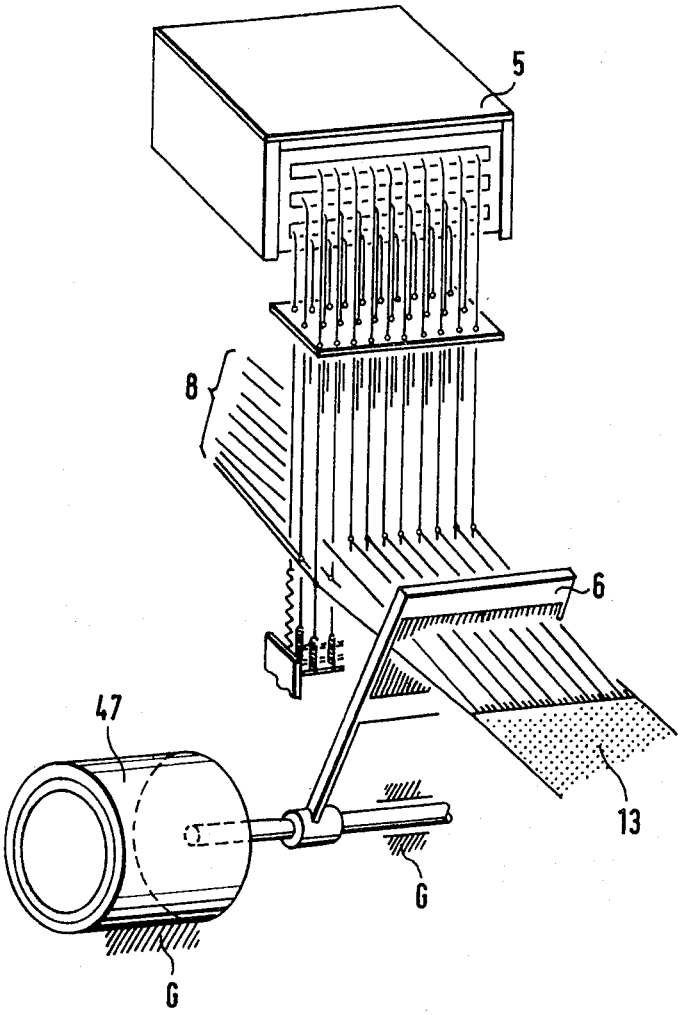
FIG. 8 is a diagrammatic perspective view showing the arrangement of a seam loom slay on the frame of the machine of FIG. 1.

The respective seam weft thread 12, which has just been introduced into the respective seam loom shed 11, is shifted by the aforementioned seam loom slay 6 toward the previously produced seam portion 13. The seam loom slay 6 is pivotally mounted on the frame G and its movement is caused by the operation of a stepping motor 47, as illustrated in FIG. 8.

The tying formations or connecting strips 38 which have been severed by the thermal cutting arrangements 39 from the web warp threads 10 are taken up, due to the action of stepping motors 48, on take-up reels 49. The connecting strips 38 are immovably connected to the clamping arrangement 9 by respective clamping devices 50 arranged at one end of the clamping arrangement 9 and connecting those portions of the strips 38 which have not yet been severed from the web warp threads 10 thereto.

As already mentioned initially, the frame G is displaceable longitudinally of the rails 2, and it is displaced, in the course of the seam weaving operation, from the one edge of the woven web to the other edge thereof. The displacement is performed on an intermittent basis and in synchronism with the progression of the seam weaving operation, in that the frame G is intermittently advanced by the stepping motor 3 via a gear transmission 51, 52.

The various stepping motors, that is the motor 3 for the frame G, the motor 25 for the disk separators 14, the motor 33 for the grippers 32, the motor 36 for the guide rods 35, the motor 46 for the floating arms 43, the motor 47 for the seam loom slay 6, and the motor 48 for the take-up reels 49 are connected, through a logic circuit or control unit of a conventional construction which has not been shown in the drawing, with the Jacquard seam loom 5, so that they bring about the respective movements of the components driven thereby in timed sequence determined by the Jacquard seam loom 5. A plurality of sensors of conventional construction is arranged at appropriate places of the machine, but such sensors have not been shown in the drawing. They control, in a well known manner, the performance of the various phases of the timed sequence.

Figure 9:
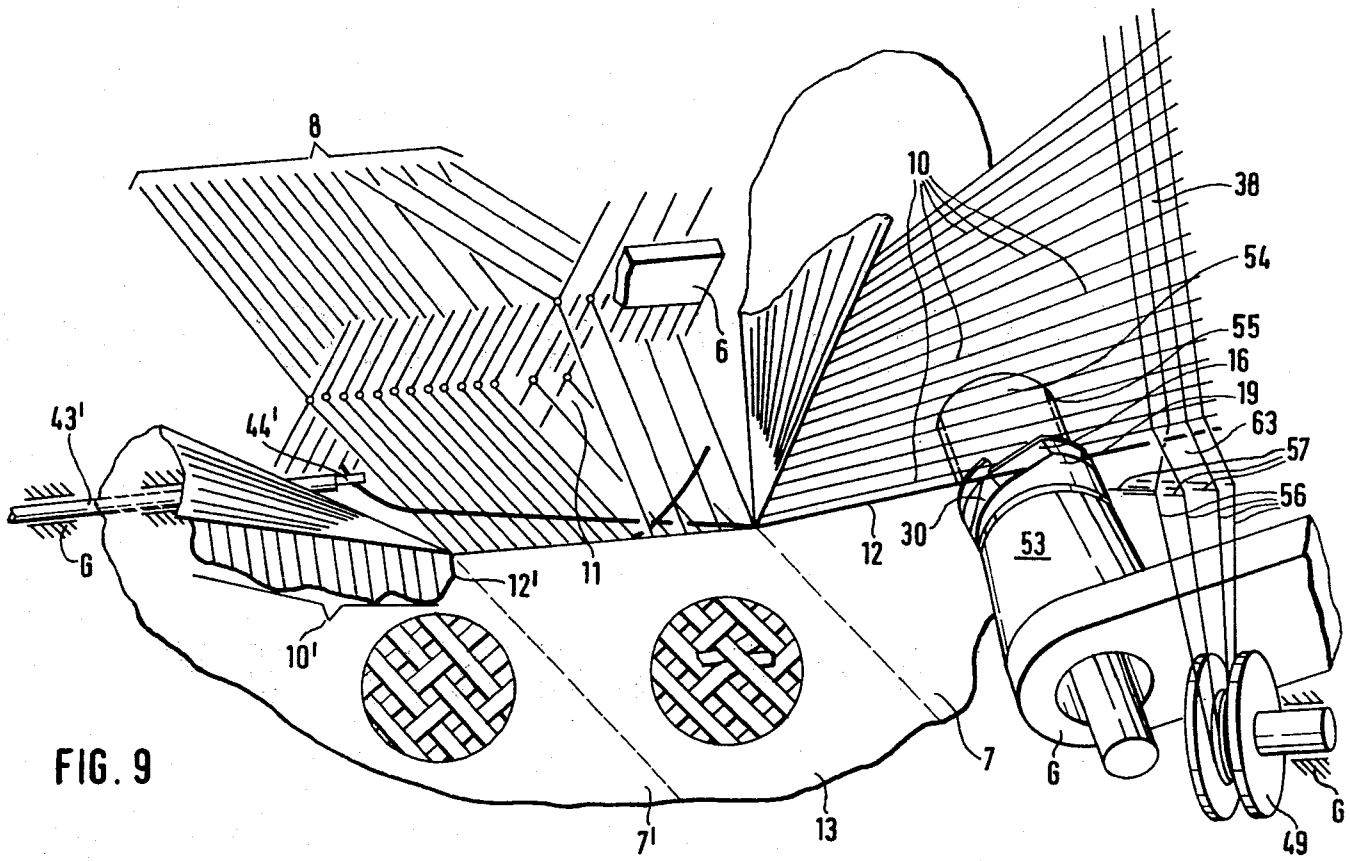
FIG. 9 is a diagrammatic perspective view of another construction of the disk separator.

Because of the considerable expense incurred in the manufacture of the separator 14 of the above construction, which usually consists of a multitude of the disks 17 and 18 (on the average, 1,000 to 1,200 such disks), it is economically feasible to use the disk separators 14 only for joining the ends of a plurality or succession of the woven webs 7 at least the web warp threads of which have the same diameter from one web 7 to another. On the other hand, when the web warp thread diameter changes from one seam weaving operation to another, a simpler disk separator 53 is to be employed instead for economical reasons. This simple disk separator 53, which is shown in FIG. 9, includes a ring 54 on the periphery of which there is provided a screw thread 55, preferably with a metric pitch. Furthermore, the separator 53 includes an inlet disk 16, a single thicker intermediate disk 18, and an outlet disk 19. The inlet disk 16, the intermediate disk 18, and the outlet disk 19 are constructed in the same manner as described above in connection with the separator 14. The purpose of the screw thread 55 on the ring 54 is to prevent the otherwise possible entrainment of the web warp threads 10 by the seam weaving machine M, M' during its advancement for joint movement therewith in the advancement direction of the seam weaving machine M, M', which would result in a situation that the drawing-in of the respective web warp thread by the inlet ring 16 into the separator 53 could not be assured under all circumstances. The release or liberation of the respective seam weft thread 12 at the separator 53 is accomplished in such a manner that the auxiliary web weft threads 56 which interconnect the web warp threads 10 at their free ends to form the tying formation or strip 38 therewith are periodically lifted or lowered by auxiliary lifting elements 57 which are connected to the ties of the Jacqard seam loom 5 and the operation of which is controlled in the timed sequence by the Jacquard seam loom 5. The released seam weft thread 12 is spatially separated from the remaining web warp threads 10 by the outlet disk 19.

The use of the two separators 14 and 53 brings about a requirement for an extremely precise guidance of the woven web 7, the ends of which are to be joined by seam 13, in relation to the seam weaving machine M, M'. The degree of precision must be of the order of magnitude of approximately 0.1 mm not only as the individual steps from one thread 10 or 12 to another are concerned, but also with respect to the traversal of the entire distance between the edges of the woven web 7, that is, the entire length of the seam 13. This means that the seam weaving machine must be capable of correcting itslef, that is, of compensating for a previous error during the following step. Such a requirement, however, can only be satisfied by employing a very intricate and extensive, and consequently, expensive array of sensors.

Figure 10:
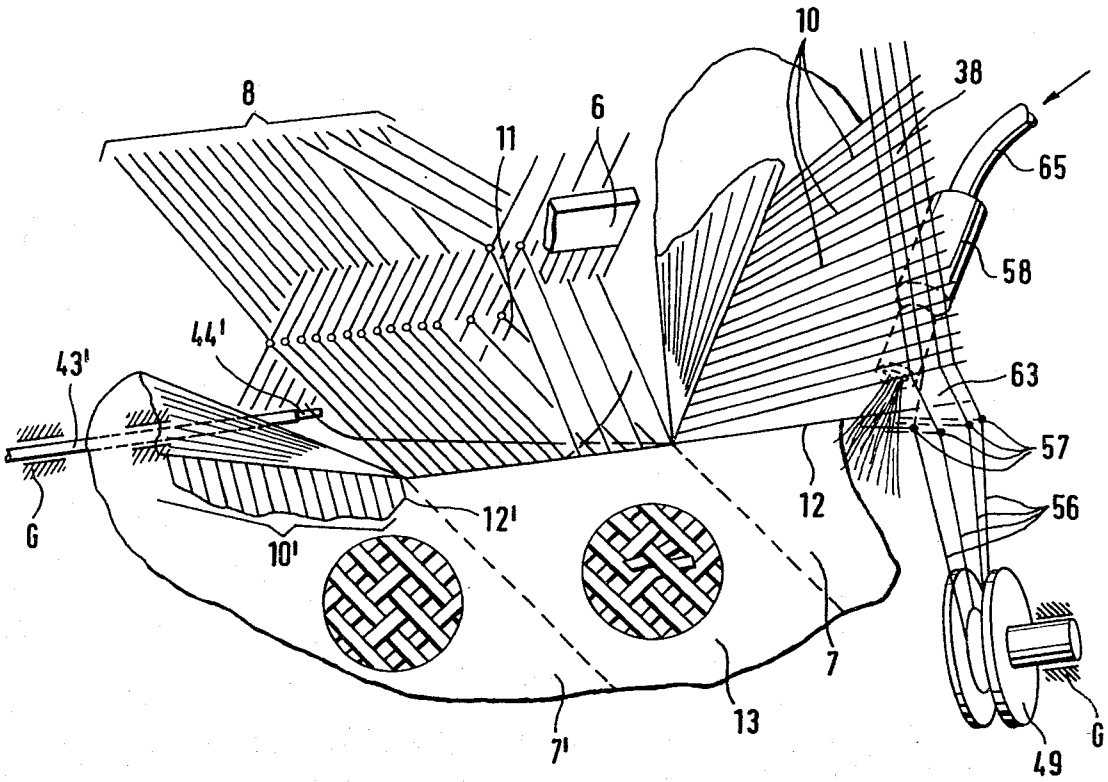
FIG. 10 is a diagrammatic perspective view of a air jet separator.

In order to reduce the otherwise desirable and/or necessary intricacy of the sensing or control equipment and to provide a simple seam weaving machine M, M', it is proposed to accomplish the spatial separation of the web warp threads 10 as well as the subsequent guidance thereof all the way to the respectively formed seam loom shed 11 by using an air stream or jet issuing from an air nozzle 58, as shown in FIG. 10. The respective web warp thread 10 which is still tied to the other threads 10 by the tying formation or strip 38 is delivered, together with the strip 38, by a tying strip guide 59, to the air nozzle 58, while the tying strip 38 is reoriented from its original substantially vertical position to a substantially horizontal position.

Figure 11:
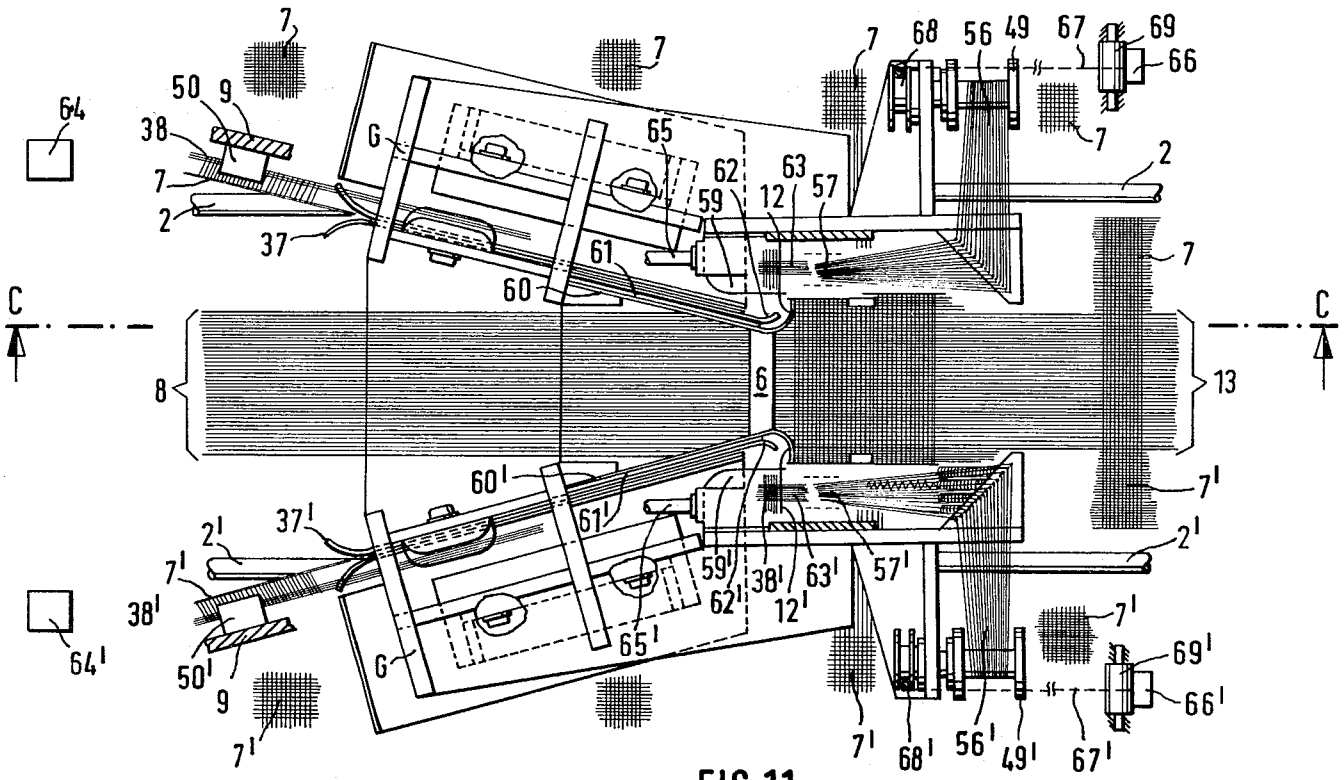
FIG. 11 is a diagrammatic view of the seam weaving machine as diagrammatically shown in FIG. 1 but incorporating the air jet separator of FIG. 10.
Figure 12:
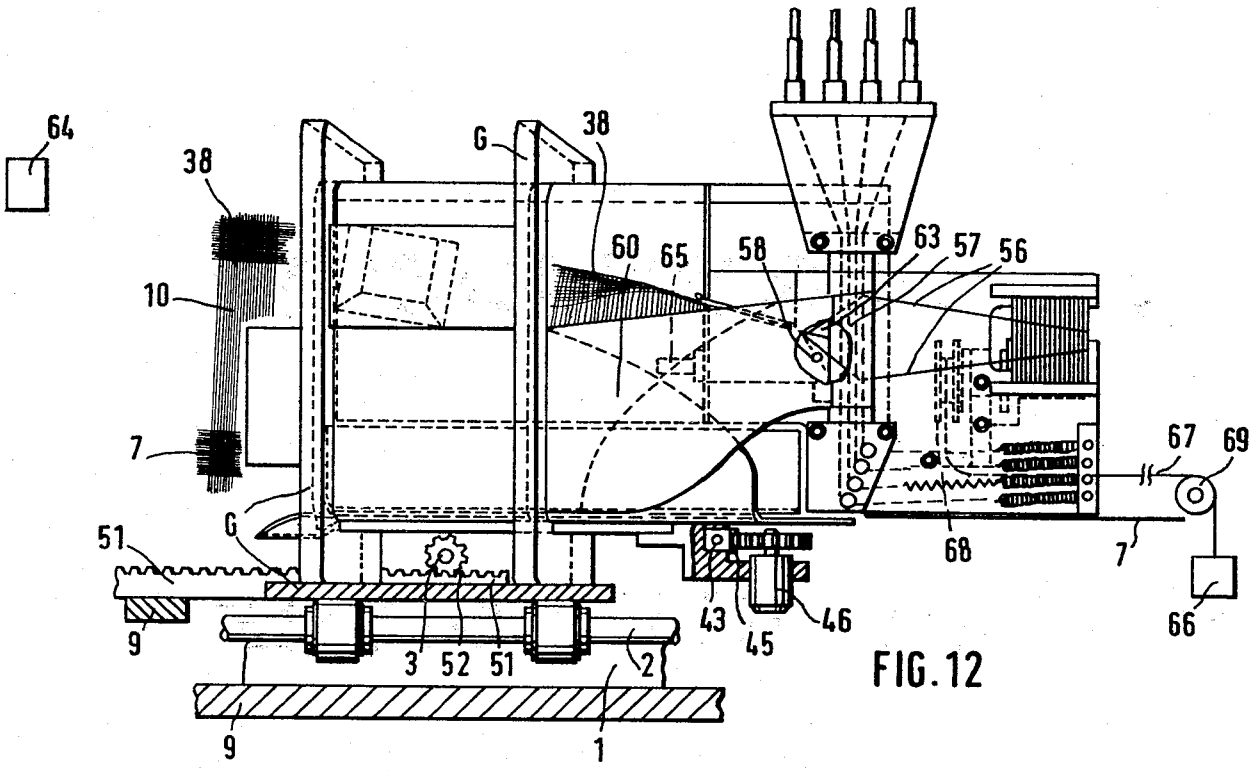
FIG. 12 is a sectional view taken on line C—C of FIG. 11.

The air nozzle 58 issues a stream or jet of air into an aerodynamically shaped channel bounded by guiding baffles 60, 61, and 62, as shown in FIGS. 11 and 12. The baffles or walls 60, 61 and 62 are preferably made of sheet metal. As a result of the reorientation of the tying strip 38 about its longitudinal axis, as well as of the opening of an auxiliary shed 63 consisting of the auxiliary threads 56 by means of the auxiliary lifting elements 57, there is created a stress situation which causes the respectively following seam weft thread 12 to dissociate itself from the tying strip 38. The dissociated seam weft thread 12 is then entrained by the air stream emanating from the nozzle 58 and is propelled thereby through the wind channel bounded by the guiding walls 60, 61 and 62, until its free end reaches the vicinity of the inlet of the respective seam loom shed 11 which has been formed at the same time. When the free end reaches this vicinity, the previously discussed floating arm 43' and more particularly its gripping arrangement 44' engages this free end and draws the same through the seam loom shed 11. Then the subsequent steps are performed in the previously discussed manner.

The air nozzle 58 is integrated into the tying strip guide 59, in order to save space. The nozzle is connected, through a magnetically operated valve 64, with an air supply conduit 65. The operation of the magnetically operated valve 64 is controlled by sensors, which have also been omitted from the drawing, and which signal the moment the floating arm 43' begins its working stroke.

As also already originally discussed, the tying strip 38 is connected to the clamping arrangement 9 at a region outside the seam weaving machine M, M'. During the performance of the operating steps of the seam weaving procedure, the tying strip 38 stands still, while the frame G advances, together with the seam weaving machine M, M', relative thereto.

The dissocated portions of the auxiliary threads 56 of the tying formation or strip 38 are being wound onto the takeup reel 49. Inasmuch as the guidance of the respective tying strip 38 with respect to the seam weaving machine M,M' must be accomplished in a very precise manner from one thread to the next one when the disk separators 14, 53 are being used, it is mandatory that the take-up reel be so rotated as to achieve tensioning of the auxiliary threads 56 in synchronism with the progression of the weaving of the seam 13. This, in turn, requires a very exact and, consequently, very complicated, control of the operation of the stepping motor 48 which operates the take-up reel 49.

This is unnecessary when the air-stream separation and air-stream guidance as discussed above is being used. Under these circumstances, it is sufficient to apply a substantially constantly high torque to the take-up reel 49. This can be accomplished, for instance, by using a rope 67 which is wound around the shaft of the take-up reel 49 and has a weight 66 attached to that end thereof which depends from the shaft, as illustrated in FIG. 11. This, of course, would ordinarily mean that, when the width of the woven web 7 is, for instance, 8 meters, a space also approximately 8 meters deep would have to be made available for the descent of the weight 66 if the latter merely freely depended from the shaft of the take-up reel 49 on the rope 67. This is avoided by providing a rope pay-out reel 68 which is coaxial with the auxiliary thread take-up reel 49 and connected to the same for joint rotation, and by winding the rope 67 carrying the weight 66 around the rope pay-out reel 68 rather than around the shaft of the take-up reel 49. In this manner, the relative movement between the machine M, M' and the woven web 7 is compensated for at a mechanical advantage resulting from the diameter differences between the reels 49 and 68, in that the no longer used auxiliary threads 56 are wound around the smaller-diameter thread take-up reel 49 and the rope 67 on which the weight 66 is suspended is wound around the larger-diameter rope pay-out reel 68.

The rope or cable 67 is deflected from its original vertical direction to a horizontal direction, as shown in broken lines in FIGS. 11 and 12, to thus extend toward and be deflected around a deflecting roller 69 from which that end of the rope 67 to which the weight 66 is connected is suspended. As a result of this measure, the relative displacement of the seam weaving machine M, M' is being used for substantially eliminating the otherwise substantial vertical movement of the weight 66.

A jet of liquid, such as water or aqueous emulsion, can be used in a similar manner instead of the air or gas jet as an entraining medium for accomplishing the thread separation. The effect is in principle the same in both instances, even though the gas stream acts on the thread 12 due to its stagnation pressure, while the liquid jet transfer an impulse to the thread 12.

However, it is also possible to accomplish the thread separation by means of electric field forces in that an electrostatic charge of one sign is applied to the respective thread 12 and an electrode charged with an electrostatic charge of the opposite sign is arranged at the other end of the trajectory in which the thread 12 is to move. The two electrodes capable of accomplishing this task have not been shown in the drawing.

The separation of the respective seam weft thread 12 as well as its conveyance to the floating arm 43' can be accomplished without insisting on the accuracy of the individual advancement steps when air jet, liquid jet, or electrostatic forces are being used for this purpose. Consequently, the control of the seam weaving machine M, M' is substantially simplified.

The tying formation 38 need not necessarily be formed by partial withdrawal of the web weft threads from the respective end portions of the woven web 7. Rather, it is also possible to remove all of the web weft threads from these end portions, and to substantially form the respective tying formations 38 by introducing auxiliary threads which did not originate in the woven web 7 between the web warp threads 10. When the expedient of using such auxiliary threads 56 is resorted to, there is obtained the advantage that one is no longer bound by the predetermined web warp thread number and distribution.

Figure 13:
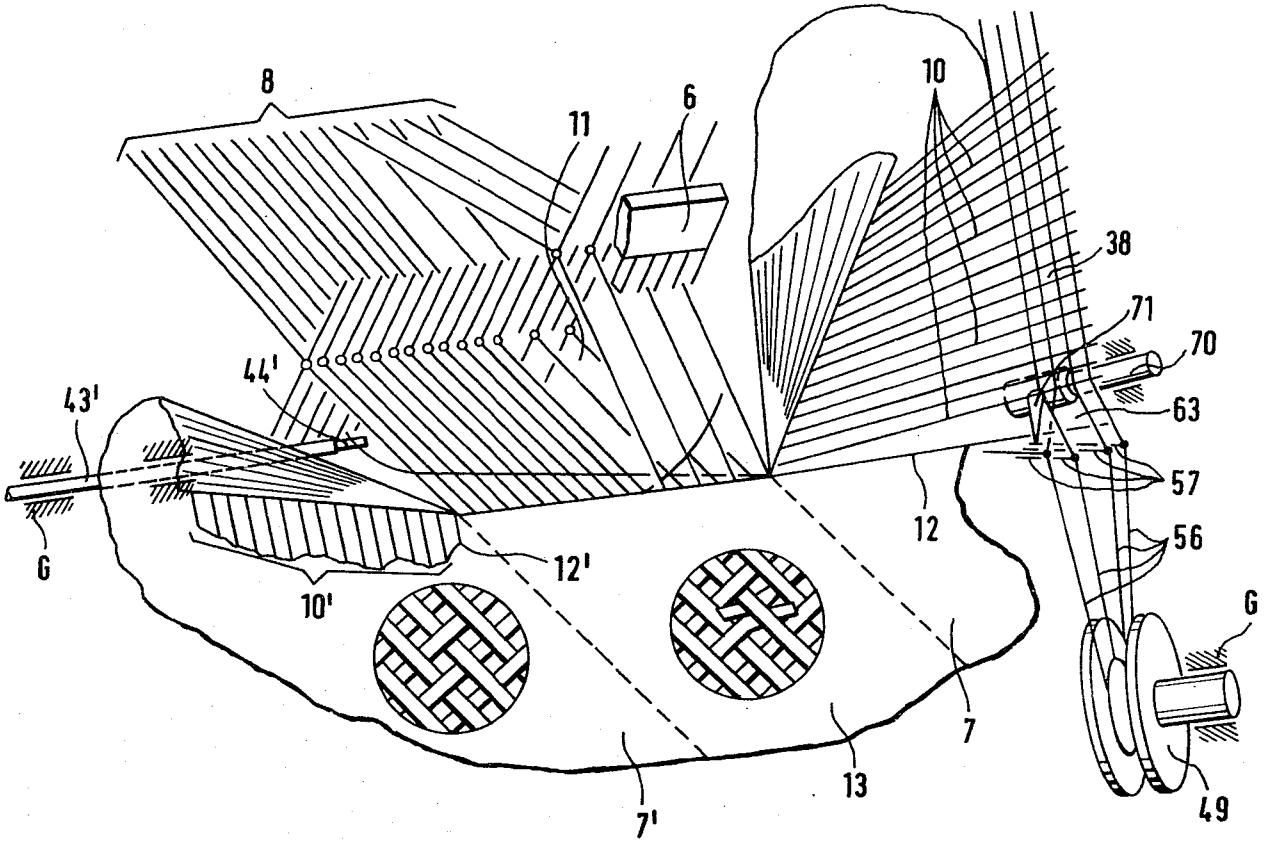
FIG. 13 is a diagrammatic perspective view of the seam weaving location showing a needle separator.

Should the web threads have such undulating configurations that the air stream or jet is no longer capable to cause the respective web warp thread 10 then expected to be converted into the seam weft thread 12 to dissociate itself from the tying formation 38 in an unaided manner, then an additional separator 70 is being used to aid in this dissociation. The additional separator 70, as illustrated in FIG. 13, is constructed as a needle separator including a brush body having at least one yieldable steel needle 71 as its bristle. During the rotation of the needle separator 70, the needles 71 tear the respective seam weft thread 12 which is then to be made available for incorporation into the seam 13 out of the tying strip 38; thereafter, the so liberated seam weft thread is conveyed in the above-discussed manner into the respective open seam loom shed 11.

As various tests have established, the seam weft thread 12, originating as the web warp thread 10, cannot always be brought into its proper position in the seam 13 as determined by the progress of the seam-weaving operation after being introduced into the corresponding seam loom shed 11 in the simple straight-line fashion by the action of the floating arm 43', by merely shifting the same toward the proper position by means of the seam loom slay 6.

Therefore, in order to assure that the respective seam weft thread 12, which still constitutes the web sharp thread 10 at the regions outside the seam 13, is brought into the desired position in the latter in the course of the respective operating step after having been introduced during the same operating step into the corresponding seam loom shed 11, it is necessary to position the respective seam weft thread 12, which has been introduced into the respective seam loom shed 11 by the operation of the respective floating arm 43', next to the previously formed seam 13 with a certain amount of pre-tension, prior to its final shifting into its proper position by the seam loom slay 6.

As a result of the positioning of the respective seam weft thread 12 next to the seam 13 under pre-tension, a relatively short but still noticeable section of the seam weft thread 12 assumes its proper position relative to the previously formed seam 13 prior to the commencement of the shifting action of the seam loom slay 6 on the respective seam weft thread 12.

Figure 18:
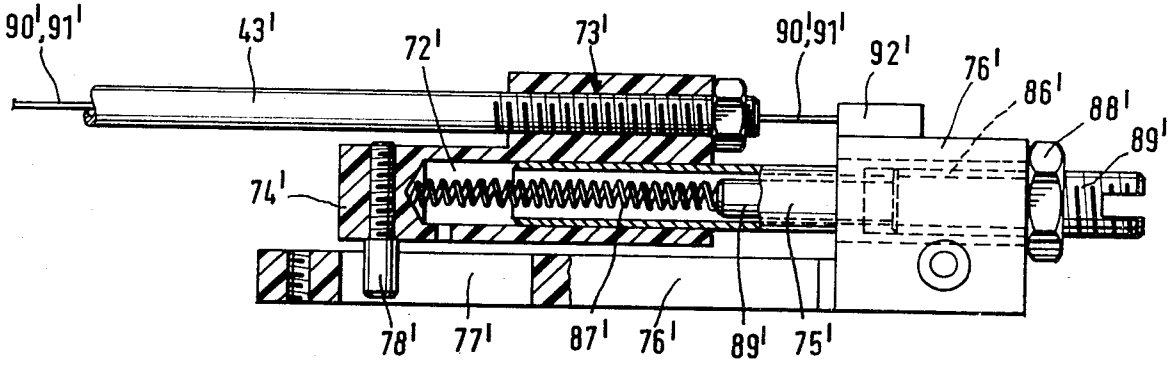
FIG. 18 is a partially sectioned enlarged side elevational view of the rocking lever part of the gripper of FIG. 14.
Figure 20:
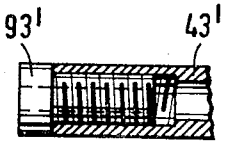
FIG. 20 is a longitudinal section of the forward free end of the gripper of FIG. 14 at an enlarged scale.
Figure 19:
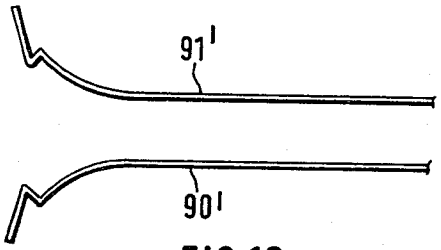
FIG. 19 is an enlarged view of the two bent clamping wires of the gripper of FIG. 14.

In order to achieve that the seam weft thread 12 can be positioned in the manner discussed above and under pre-tension prior to its shifting toward the previously formed seam 13 by the seam loom slay 6, the floating arm 43′ is given a tubular configuration, as illustrated in FIG. 18, and is rigidly connected, by means of a screw-threaded connection, with a shifting element 74′. As illustrated, the shifting element 74′ has a longitudinally extending blind bore 72′, and a through bore 73′ situated above the blind bore 72′ and parallel with its longitudinal axis, the floating arm being threaded into the through bore 73′ which is provided with an internal thread for this purpose, while the floating arm 43′ has a meshing external thread on that portion thereof which is received in the through bore 73′. The blind bore 72′ of the shifting element 74′ partially accommodates a guiding tube 75′ which passes through a bore in the thicker arm of an L-shaped rocking lever 76′. Turning of the shifting element 74′ is prevented by a bolt 78′ which is guided in an elongated slot 77′ that is formed in the other, substantially flat, arm of the rocking lever 76′. The bolt 78′ is secured to the shifting element 74′ by being threaded into a bore of the latter which extends substantially normal to the longitudinal axis of the shifting element 74′.

Figure 15:
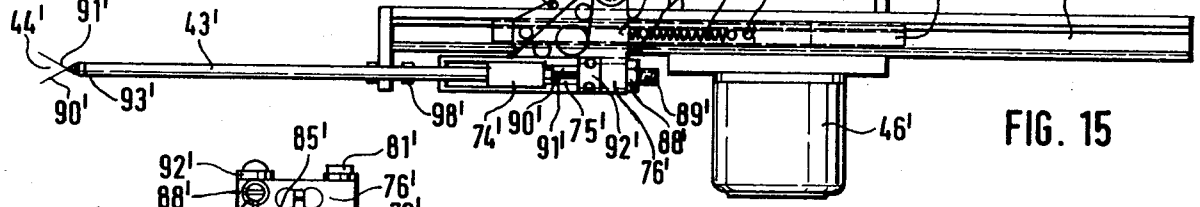
FIG. 15 is a top plan view of the gripper shown in FIG. 14.
Figure 16:
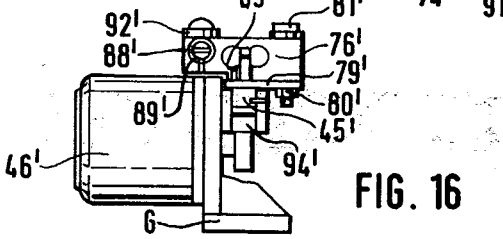
FIG. 16 is a rear elevational view of the gripper shown in FIG. 14.

The substantially L-shaped rocking lever 76′, which is also shown in FIG. 15, is pivotally mounted on a bolt 81′ at its arm facing in the seam advancement direction. The bolt 81, in turn, is mounted on a base plate 79′ and is prevented from turning about its axis by means of a nut 80′. The base plate 79′ is connected to the toothed portion 45′ of the floating arm 43′ by means of screws. Another bolt 83′ is mounted in the arm of the rocking lever 76′ which extends normal to the seam weaving direction, while still another bolt 84′ is rigidly connected to the base plate 79′. A spring 82′ extends, in its tensioned condition, between the bolts 83′ and 84′ and urges the L-shaped lever 76′ into abutment with an abutment bolt 85′ which is threaded into a corresponding bore in the base plate 79′, that is, into a position in which the substantially flat arm of the rocking lever 76′ is oriented exactly normal to the seam weaving direction.

An inner thread is formed at the end of the guiding tube 75′ which is supported in the rocking lever 76′, this inner thread being indicated at 86′. A compression spring 87′ is accommodated in the interior of the guiding tube 75′, and it can be pre-tensioned against the shifting element 74′ which is shiftably mounted on the guiding tube 75′ by means of a threaded pin 89′ meshing with the inner thread 86′ of the guiding tube 75′ and prevented from undesired loosening by a securing nut 88′.

The shifting element 74′ rests against steel wires 90′, 91′ which constitute the seam weft thhread clamping arrangement 44′. The steel wires 90′ and 91′ are soldered to a clamping plate 92′ which is securely attached to the rocking lever 76′, and they pass through the interior of the tubular floating arm 43′, as well as through an axial bore of a plug 93′ of synthetic plastic material which is threaded into the forward end of the floating arm 43′.

Each of the two steel wires 90′, 91′ forming the seam weft thread clamping arrangement 44′ proper extends along an arcuate course at first so that it obtains a pre-tension which is directed away from the original longitudinal axis and thus from the longitudinal axis of the tubular floating arm 43′ which accommodates the steel wires 90′, 91′ along a considerably part of their lengths. Then, each of the steel wires 90′, 91′ is bent twice toward its free end so that it has a V-shaped configuration with arms of different lengths as considered in the top plan view at this region, of which the shorter arm is interposed between and connected to the longer arm and to the curved section of the respective steel wire 90′ or 91′. The configuration of the steel wire 91′ is a mirror image of that of the steel wire 90′.

The opening and closing of the seam weft thread clamping arrangement 44′ is achieved by causing a relative shifting between the floating arm 43′ which is supported in the shifting element 74′ and the steel wires 90′, 91′ which are soldered to the clamping plate 92′ that is secured by screw thread connection to the rocking lever 76′, and which pass through the floating arm 43′ and through the plug 93′ of synthetic plastic material.

Figure 17:
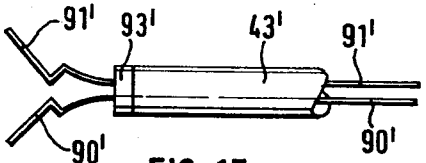
FIG. 17 is an enlarged view of the free forward end of the gripper shown in FIG. 14 with clamping wires in their open position.

More particularly, as the floating arm 43′ is displaced toward the clamping plate 92′, the steel wires 90′, 91′ which are bent to their V-shaped configurations are extended to a larger degree than before out of the tubular floating arm 43′. Under the influence of the pre-tension which exists in the steel wires 90′, 91′ and which is active in the laterally outward directions, the V-shaped end portions of the steel wires 90′, 91′, which are in registry with one another, move toward their open positions and form an open plier-like structure, as illustrated in FIG. 17, which is adapted to surround the respective seam weft thread 12 which is then available for weaving into the seam 13.

Figure 14:
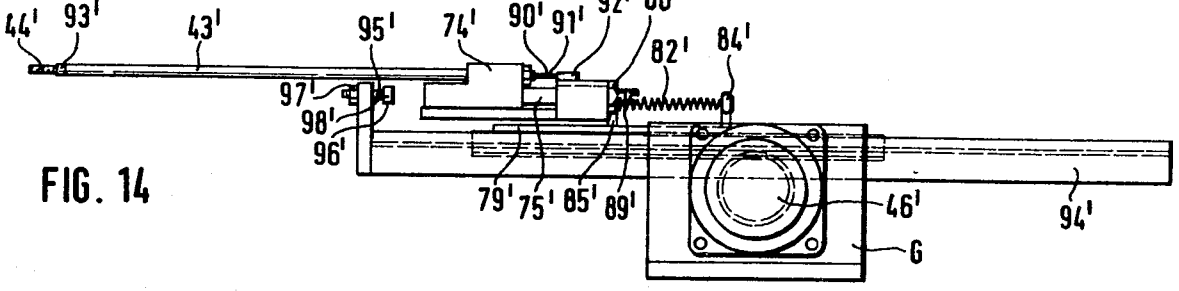
FIG. 14 is a side elevational view of a gripper for clamping the seam weft thread.

This relative shifting between the floating arm 43′ and the steel wires 90′, 91′ partially accommodated therein is achieved in that the shifting element 74′ abuts against a positionally adjustable stop 98′ seen in FIG. 14, which is mounted at the end (as seen in the direction of movement of the toothed rack for the introduction of the floating arm 43′ in the seam loom shed 11) of a toothed rack guide 94′ supported on the frame G, by means of a threaded connection 95′, which is provided with a body of a noise-suppressing material 96′, and which is secured against un-intentional loosening by a nut 97′, shortly before reaching the end of the maximum stroke thereof. As a result thereof, the shifting element 74′ is displaced against the opposition of the spring force of the compression spring 87′ relative to the guide tube 75′ which is stationarily supported in the rocking lever 76′. As a result of the relative shifting between the shifting element 74′ and the guide tube 75′, the floating arms 43′ which is securely threadendly connected to the shifting element 74′ is shifted relative to the steel wires 90′, 91′ which are soldered to the clamping plate 92′ and rigidly connected with the rocking lever 76′ by means of the clamping plate 92′, with the result as discussed above.

After the achievement of the maximum stroke, the toothed rack or portion 45′ moves back, and the floating arm 43′ remains immovable until the bent portions of the steel wires 90′, 91′ come into contact with the synthetic plastic material plug 93′. The compression spring 87′ braces against the shifting element 74′ as well as against the threaded pin 89′; the shifting movement of the floating arm 43′ is limited by the contact of the bent portions of the steel wires 90′, 91′ with the synthetic plastic material plug 93′.

The seam weft thread 12 originating as the web warp thread 10 which is engaged by the seam weft thread clamping arrangement 44′ causes, by its stationary position in the woven web 7 as well as by its length obtained by the removal of the original web weft threads, that a tensional stress builds up in the seam weft thread 12 after the latter has been transferred by the floating arm 43′ through the respective seam loom shed 11 to a distance corresponding to the full length of the seam weft thread 12, due to the action of the spring force of the tension spring 82' which urges the L-shaped rocking lever 76' toward abutment with the rear abutment bolt 85'. This tensional stress in the seam weft thread 12, which increases with the continuing retraction of the floating arm 43' causes the L-shaped rocking arm 76' to perform a pivoting movement opposite to the seam weaving direction, which pivoting movement continues until the rocking lever 76' abuts a forward abutment 99'. As a result of the pivoting movement of the L-shaped rocking lever 76', which is caused by the tensional stress in the seam weft thread 12 in its stretched condition, there comes into existance a reaction force which brings the seam weft thread 12 into a position parallel to the seam 13. The rearward reversal point of the stroke of the floating arm 43' is so selected that the seam weft thread 12 is extracted from the seam weft thread clamping arrangement 44' after the seam weft thread 12 has reached the above-mentioned parallel position. As discussed above, the seam weft thread clamping arrangement 44' engages the seam weft thread 12 at the commencement of the introduction thereof into the seam loom shed 11 at the entrance of the latter, and then the seam weft thread clamping arrangement 44' is caused by the toothed rack 45' to conduct a withdrawal movement thereof across the seam loom shed 11 while the seam weft thread 12 is entrained for introductory movement thereof across the same seam loom shed 11.

In the preceding description, the use of a seam loom slay 6 having a construction and use well known and frequently employed in the weaving field has been presupposed. This conventional seam loom slay 6 controls, on the one hand, the shifting of the respective seam weft thread 12 toward the seam 13 and, on the other hand, the achievement of a predetermined distance between the individual seam weft threads 12 in the beam 13.

It is advantageous to use for the seam warp threads 8 those web weft threads which have been removed from the end portions of the woven web 7 prior to the formation of the seam 13. A particular advantage of this is that, since not only the seam weft threads 12, but also the seam warp threads 8, have previously constituted constituent threads of the woven web 7, they have acquired undulating shapes as considered in their respective longitudinal directions during their weaving into and incorporation in the woven web 7 so that the seam weft threads 12, once shifted toward the seam 13 by the seam loom slay 6, automatically reassume their proper positions relative to the seam warp threads 8 as predetermined by the undulations remaining from the preceding web weaving process. This, of course, presupposes that the undulations remain in the respective threads 8 and 12 once the same have been released from the confinement in the woven web 7. Under these circumstances, any shifting of the seam weft threads 12 which have been introduced into the respective seam loom shed 11 in its open position and shifted toward the previously formed section of the seam 13 relative to the seam warp threads 8 originating in the woven web 7, as well as any shifting of the seam warp threads 8 relative to the seam weft threads 12, is no longer possible without external influence even prior to the closing on the respective seam loom shed 11, inasmuch the previously acquired undulations as formed in the woven web 7 on the seam weft threads 12 and the seam warp threads 8 prevent such shifting.

Figure 21:
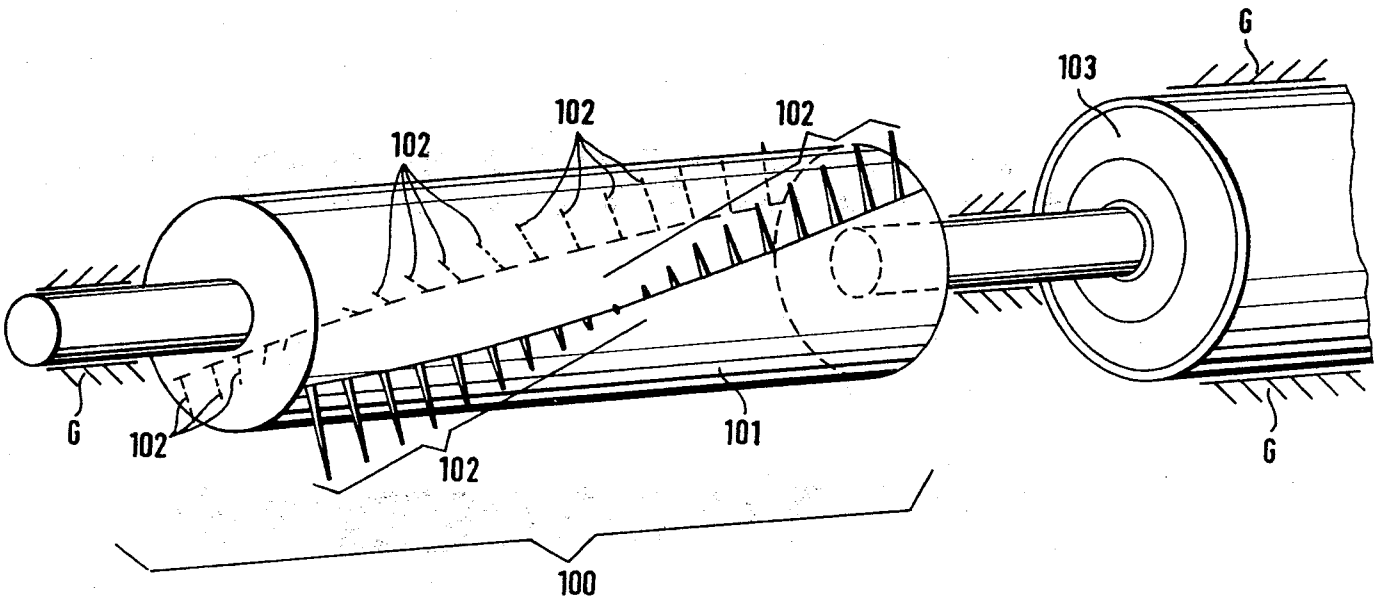
FIG. 21 is an enlarged perspective view of a needle roller for shifting the seam weft threads.

Each particular type of weave requires an especially constructed seam loom slay 6; however, the manufacture of such specially made seam loom slays 6 is quite expensive. In the above-discussed seam weaving operation, the seam loom slay 6 has the only purpose of shifting the seam weft threads 12 toward the previously formed section of the seam 13. Inasmuch as the undulating configurations of the seam weft threads 12 and of the seam warp threads 8 renders any relative shifting between the seam weft threads 12 and the seam warp threads 8 impossible, even before the respective seam loom shed 11 is closed, the shifting of the seam weft thread 12 toward the previously produced section of the seam 13 can be accomplished, in accordance with a further feature of the present invention, by means of a needle roller 100 shown in FIG. 21, which is rotatably supported on the frame G. The advantage of such needle roller 100 is that it can be used for all types of weave, without any need for replacing the same.

The needle roller 100, which is rotatably supported on the frame G, essentially consists of a shaft 101 on which there are mounted two rows of flexible needles 102. Each of the rows includes a plurality of the needles 102 and extends along a helical course over the length of the shaft 101. The two rows of the needles 102 are arranged opposite one another across the diameter of the shaft 101. A first of these rows of needles 102 is arranged along a clockwise helical course, while the second of such rows is situated along a counterclockwise helical course.

This latter measure is necessary in order to achieve a situation where the seam weft thread 12 which has been introduced into the respective seam loom shed 11 is shifted toward the previously formed section of the seam 13 in a digital or discrete-step fashion, beginning at the point of emergence of the seam weft thread 12 out of the woven web 7, in discrete steps corresponding to the arrangement of the flexible needles 102.

The needle roller 100 is driven by a stepping motor 103 in such a manner that, during each seam weaving step, it conducts an angular displacement through 180°, whereafter any further rotation is terminated until the next following seam weaving step.

As a result of the angular displacement, which is limited to 180° for each seam weaving step and then discontinued, of the needle roller 100 about its longitudinal axis, the individual needles 102 of the needle roller 100 slide on and finally past the respective seam weft thread 12 and scratch the same, leaving scratch traces or marks behind. Such scratch marks, however, can cause damage to the seam 13 or at least deleteriously influence the strength of the latter under certain conditions.

Figure 22:
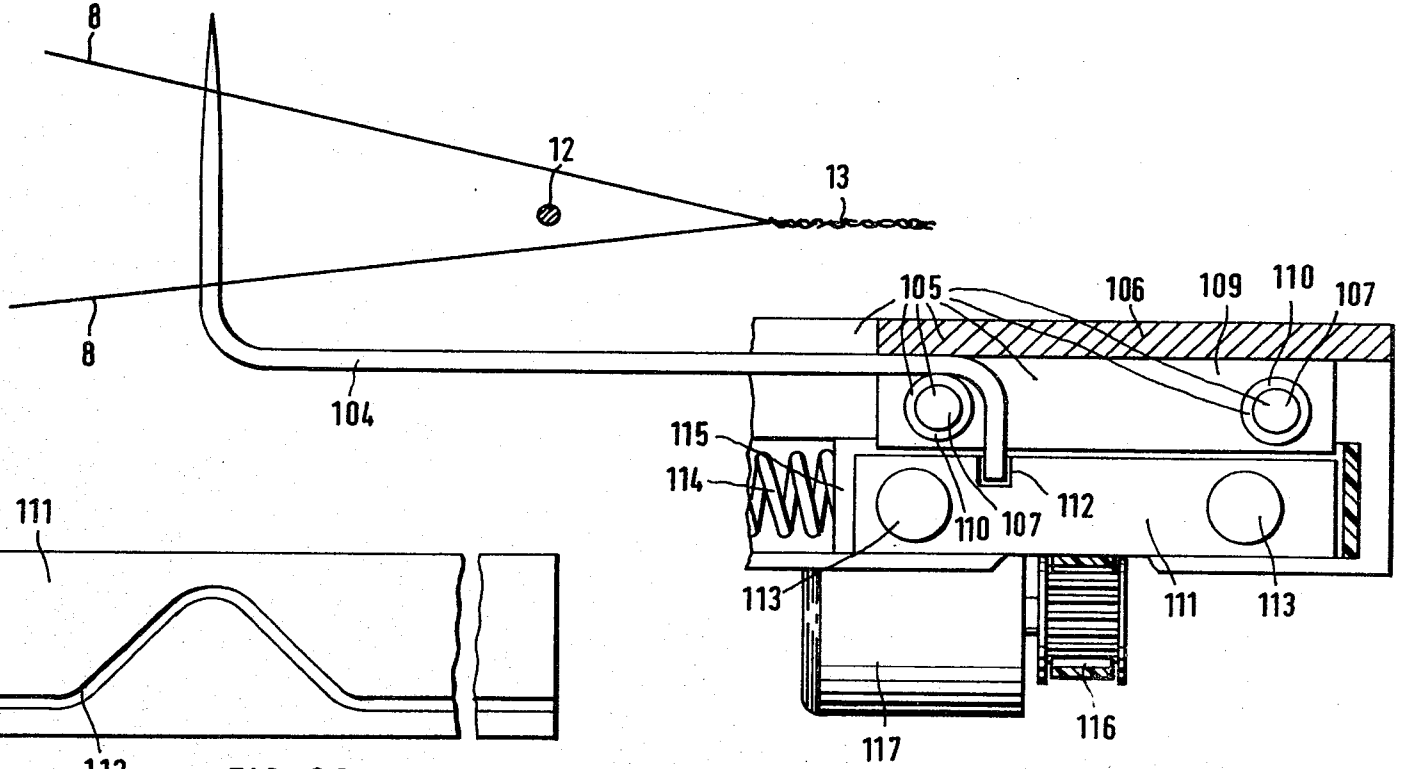
FIG. 22 is a partially sectional fragmentary view of a guide bed accommodating a Z-shaped needle for shifting the seam weft threads.

When it is imperative to avoid such scratch marks, it is possible to use Z-shaped needles 104 illustrated in FIG. 22 for the shifting of the seam weft threads 12 toward the previously formed section of the seam 13. The Z-shaped needles 104 are arranged in a needle bed 105 next to each other, are individually axially shiftable, and reach into the seam loom shed 11 at their respective Z-shape ends.

The guide bed 105 for the Z-shaped needles 104 is rigidly mounted on the frame G, and it includes a base plate 106 and two guide rods 107 which are stationarily arranged in the base plate 106. On these two guide rods 107, there are mounted, in an alternating manner, sheet-metal members 109 reinforced against bending and each having two bores 108, and distancing sleeves 110. The sheet-metal members 109 and the distancing sleeves 110 are to slid onto the guide rods 107 that an initial sheet-metal member 109 is followed by a distancing sleeve 110 on each of the guide rods 107, these two distancing sleeves 110 are followed by another sheet-metal member 109 receiving the two guide rods 107 in the respective bores 108 thereof, and so on, until finally the last two distancing sleeves 110 on the two rods 107 are followed by the last sheet-metal member 109. Each distancing sleeve 110 has a length which, in cross-section, corresponds to the corresponding dimension of the respective Z-shaped needle 104 and thus permits the longitudinal shifting of the associated Z-shaped needle 104 from one of the distancing sleeves 110 all the way to the axially adjacent distancing sleeve 110.

Figure 24:
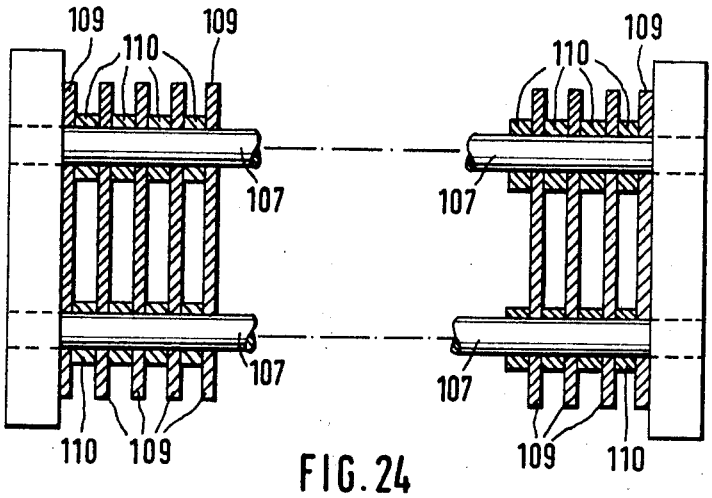
FIG. 24 is a partially sectioned top plan view of the guiding bed of FIG. 22.
Figure 25:
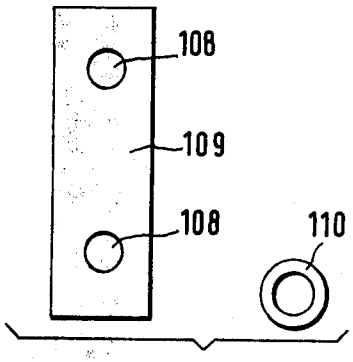
FIG. 25 is a view showing the transverse plates and distancers of the guide bed of FIG. 22.

The vertical distance of the guide rods 107 at the region of the base plate 106 which overlies the seam 13 is such that the Z-shaped needles 104 shiftably fit, without play, between the base plate 104 and the outer peripheral surface of the respective distancing sleeve 110 slid onto the respective guide rod 107. This will become apparent when FIGS. 22 and 24 are considered.

Figure 23:
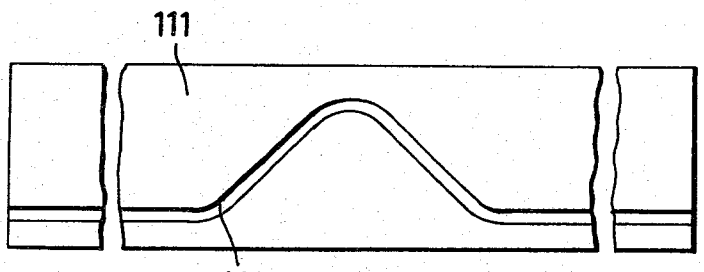
FIG. 23 is a top plan view of a shifter controlling the movement of the Z-shaped needle of FIG. 22.

As a result of this construction of the needle bed 105, the Z-shaped needles 104 are so mounted as to be prevented from turning and as to be capable of axial displacement. The axial displacement of the Z-shaped needles 104 for the purpose of shifting the respective seam weft thread 12 introduced into the respective seam loom shed 11 opposite to the advancement direction of the seam weaving operation is accomplished by means of a slider 111 provided with a groove 112 which extends normal to the advancement direction of the seam weaving operation at the first third of the slider length, arcuately with respect to the seam weaving advancement direction at the second third of the slider length, and again normal to the seam weaving advancement direction at the third third of the slider length, as shown in FIG. 23. The total length of the slider corresponds to three times the width of the seam 13. Rear ends of the individual Z-shaped needles 104 are received in the groove 112. The slider 111 is mounted on two special slider guide rods 113 for movement transversely to the advancement direction of the seam weaving operation.

Figure 26:
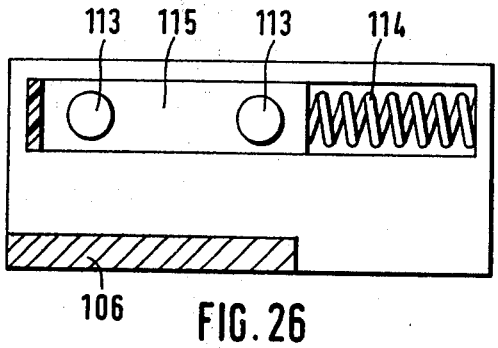
FIG. 26 is a top plan view of a guide element for the shifter rods mounted in the guide bed of FIG. 22.

The slider guide rods 113 are supported at each lateral region of the base plate 106 on a shifting element 115 which is shiftable on the base plate 106 in the seam weaving advancement direction and which is urged oppositely to the seam weaving advancement direction by an adjustable urging arrangement 114 (either a helical spring or a pressurized air cylinder-and-piston unit). The simultaneous shifting of the two slider guide rods 113 and thus also of the slider 111 which is supported thereon is necessary in order to assure that the stepped advancement of the frame G have no tolerance-related feedback effect on the shifting of the seam weft thread 12 introduced into the respective seam loom shed 11 toward the previously formed section of the seam 13. The details of this constructions may be seen in FIG. 26.

The slider 111 is connected, as shown in FIG. 22, with a toothed belt (or rope) drive 116 and is displaced by the latter, with the aid of a stepping motor 117, in synchronism with the progression of the seam weaving operation, from the corresponding side of the seam 13 to the other side and back.

As a result of this shifting of the slider 111 from one side of the seam to the other and back, the Z-shaped bent needles 104, the rear ends of which reach in the groove 112 of the slider 111, individually and in succession conduct axial movement corresponding to the configuration of the groove 112, all the way to the saem 13 and back into their respective original positions.

As a result of this axial shifting of the slider 111 and of the individual Z-shaped needles 104 as well, which shifting occurs in timed sequence of the seam weaving operation, the respective seam weft thread 12 which is introduced into the respective seam loom shed 11 by means of the floating arm 43' is shifted toward the previously formed section of the seam 13, beginning at the point of emergence of the seam weft thread 12 out of the woven web 7, in consecutive increments progressing toward the free end of the respective seam weft thread 12. As already mentioned before in connection with the description of the operation of the needle roller 100, the seam weft thread 12 will remain in its position as predetermined by the weaving operation even while the respective seam loom shed 11 is still open, without any need for taking additional measures in order to accomplish this purpose.

Figure 27:
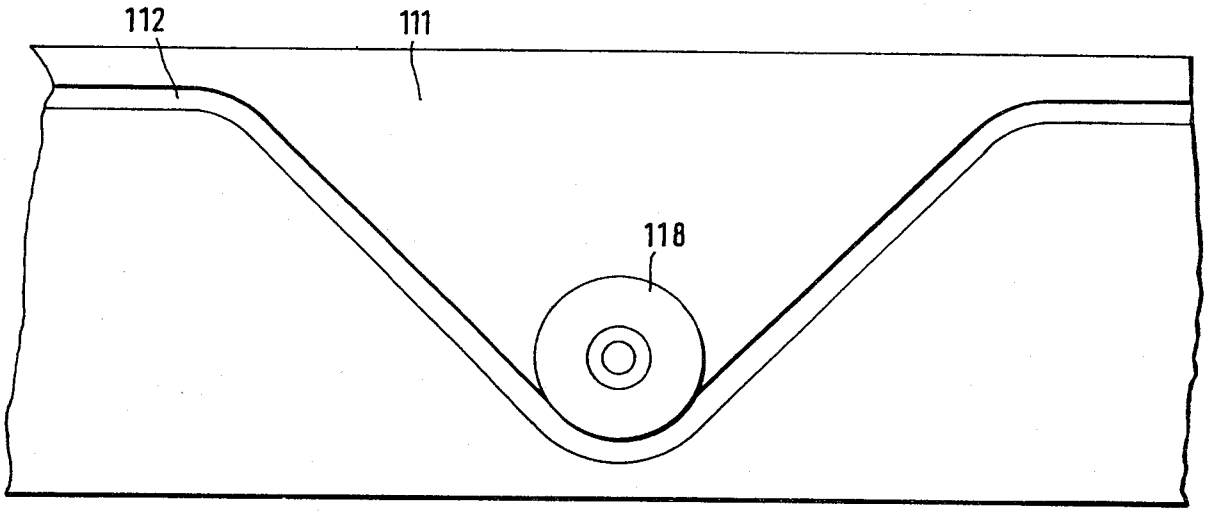
FIG. 27 is a view similar to FIG. 23 showing a deflecting roller in a side elevational view at the shifter.
Figure 30:
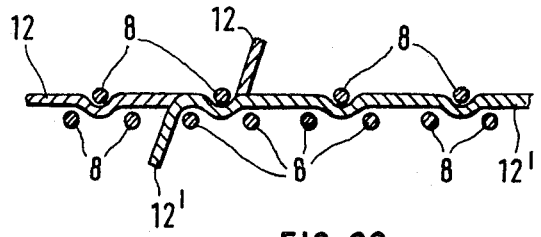
FIG. 30 is an enlarged sectional view taken trough a seam formed in the manner shown in principle in FIG. 29.

The above-discussed construction of the slider 111, as advantageous as it may be in other respects, still possesses a drawback residing in the fact that, as a result of the deflection of the rear ends of the needles 104 in the arcuate central section of the groove 112, a relatively high friction exists between the Z-shaped needles 104 and the slider 111. This high friction, in turn, results in a very high wear of the cooperating portions, as well as in a very high power consumption for operating the slider 111. Therefore, in a construction of the slider 111 which is structurally more advantageous than that described above, the axial shifting of the Z-shaped needles 104 is accomplished no more by the arcuate section of the groove 112 at the second third of the overall length of the shifter 111, but rather by a rotatable roller 118 which is being used instead of the curved portion, as shown in FIG. 27.

As a result of the shifting of the seam weft thread 12, which has been introduced into the respective seam loom shed 11 by means of the floating arm 43', by means of the individual Z-shaped needles 104 which are shifted in the seam weaving direction by the shifter 111, the driving power consumed for the shifting of the seam weft thread 12 toward the previously formed seam section can be reduced as compared to that needed when the seam loom slay 6 or the above-discussed needle roller 100 is being used.

When the Jaquard seam loom 5 is equipped with the sufficient necessary amount of ties 119, it is possible to achieve a three-stage lifting of the seam warp threads 8. To this end, the ties 119 of the Jacquard seam loom 5 are connected to one another in such a manner that, when the Jacquard seam loom 5 has, for instance, 601 ties 119, the first tie 119 is connected with the six-hundred first one, the second with the six-hundredth one, the third with the five-hundred ninety-ninth one and so on. The interconnected ties 119 form loops which are trained around a summation roller 120. When this expedient is being used, the duration of the seam weaving operation is reduced by approximately one-half, and this is achieved without having to increase the speed at which the individual operations of the seam weaving machine M, M' are being performed. Structural details of this arrangement may be ascertained from FIG. 28.

A special-purpose tie 122 is connected to a rotary axle 121 of the summation roller 120, and a main lifting element 123 for the respective seam warp thread 8 is mounted thereon. In the continuation of the tie 122 beyond this point, the latter is guided around a rotatably supported deflecting roller 124 and is connected to a tension spring 125 which is attached to the frame G.

The operation of the Jacquard seam loom 5 is controlled in the conventional manner by using perforated cards. The Jacquard card here in question is perforated in correspondence with the timed sequence of the seam weaving operation, and it renders it possible to lift the main lifting element 123 in three discrete stages and, as a result thereof, to simultaneously form two seam loom sheds 11 and 11'. Herein, the seam loom shed 11 is formed upwardly and the seam loom shed 11' downwadly of the plane of the web 7 and of the previously formed seam 13, as shown particularly in FIG. 29.

In the event that the number of the ties 119 of the Jacquard seam loom 5 is insufficient for proceeding in this manner, another Jacquard seam loom 126 can be arranged next to the originally discussed Jacquard seam loom 5, the Jacquard seam looms 5 and 126 being connected to one another for joint rotational movement of the rotary components thereof by means of a common shaft 127. Then, the ties 119 and 128 of the two Jacquard seam looms 5 and 126 are connected to one another, in a crosswise manner using the principles discussed above, in that, for instance, the first tie 119 of the first Jacquard seam loom 5 is connected with the corresponding first tie 128 of the second Jacquard seam loom 126, and so on. Then, the simultaneous formation of the two seam loom sheds 11 and 11' occurs in the manner discussed above, in that the perforated cards controlling the operation of the two Jacquard seam looms 5 and 126 are correspondingly correlated to one another.

It will be understood that each of the elements described above, or two or more together, may also find a useful application in other types of arrangements differing from the type described above.

While the invention has been illustrated and described as embodied in a seam-weaving arrangement for fabric-like woven structures, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. A method of producing an interwoven seam interconnecting two end portions of a woven structure including an array of parallel warp threads and an array of parallel weft threads interwoven with the array of warp threads at right angles thereto, particularly for making an endless woven band, especially for use in the paper-manufacturing industry, comprising the steps of:

forming a tying strip at the free ends of the warp threads of each of the end portions to be interconnected, by removing some of the weft threads from each of the end portions and retaining some of the weft threads at the free ends of the warp threads such that the tying strip is disposed at the free ends of the warp threads, spaced from the remainder of the woven structure and connected thereto only by the warp threads and holds the free end of the warp threads in their original order;

positioning the end portions in registry with one another such that the weft threads are coextensive and the warp threads substantially register with one another;

positioning seam warp threads between the points at which the warp threads emerge from the woven structure and forming a seam loom shed from the seam warp threads;

releasing the warp threads in their original order from the tying strip by periodically lifting and lowering the weft threads of the tying strip which interconnect the warp threads at their free ends;

separating one of the warp threads at a time in space from the following warp threads;

mechanically introducing the released and separated warp thread as a seam weft thread into the respective seam loom shed and transporting such seam weft thread across the respective seam loom shed;

shifting such seam weft thread within the seam loom shed into its proper position in the seam being formed;

repeating the releasing, separating, introducing and shifting steps with another warp thread stemming from the respectively other end portion such that the other warp thread is transported across the further seam loom shed in the opposite direction;

detaining the properly positioned respective seam weft threads in the seam, including forming a following seam loom shed; and advancing the seam weaving operation by a step having a length corresponding to the spacing between the individual warp threads in timed sequence with the operating steps of releasing, separating, introducing, shifting, detaining and repeating.

2. The method as defined in claim 1, wherein said advancing step is performed intermittently in timed sequence with the operating steps.

3. The method as defined in claim 1, wherein said advancing step is performed continuously during the timed sequence of the operating steps.

4. The method as defined in claim 1, wherein said shifting step includes using a needle roller for engaging the respective seam weft thread and displacing the same into the respective seam loom shed nip.

5. The method as defined in claim 1, wherein said introducing step includes entraining the respective seam weft thread in a gaseous medium jet, and controlling the direction of the jet in a three-dimensional manner.

6. The method as defined in claim 1, wherein said operating steps further include the step of severing the overlapping portions of the respective and other seam weft threads at the region of the overlap.

7. The method as defined in claim 1, wherein said seam loom shed and said further seam loom shed are formed simultaneously in a three-stage operation, wherein said seam weft thread and said other seam weft thread simultaneously transported in opposite directions across the respectively associated seam loom sheds; and wherein said seam weft thread and said other seam weft thread are simultaneously shifted into their proper positions prior to their detention therein due to the closing of the respectively associated seam loom sheds.

8. An apparatus for producing an interwoven seam interconnecting two end portions of a woven structure including an array of parallel warp threads and an array of parallel weft threads interwoven with the warp threads at right angles thereto, particularly for making an endless woven band, especially for use in the paper-manufacturing industry, comprising:

means for positioning the end portions to be interconnected, from which at least some of the weft threads have been removed to form a tying strip holding the warp threads of each of the end portions in their original order at their free ends and at a predetermined distance from the remainder of the woven structure, in registry with one another such that the waft threads are coextensive and the warp threads substantially register with one another;

means for clamping the ends of the tying strip to the means for positioning the end portions of the woven structure;

means for positioning seam warp threads between the points at which the warp threads emerge from the woven structure;

lifting elements for periodically lifting and lowering the tying strip weft threads which interconnect the warp threads at their free ends for gradually releasing the warp threads from the tying strip in their original order;

means for mechanically separating one of the warp threads at a time in space from the following warp threads;

means for forming a succession of seam loom sheds from the seam warp threads;

means for mechanically introducing the released and separated warp threads associated with the respective end portions of the woven structure as respective seam weft theads in opposite directions into, and for transporting such seam weft threads in said opposite directions across the respectively associated seam loom sheds;

means for shifting the respective seam weft threads within the respectively associated seam loom sheds into their proper positions in the seam being formed, in which positions they are detained upon closing of the respectively associated seam loom sheds; and means for advancing the seam weaving operation by a step having a length corresponding to the spacing between the individual warp threads of the woven structure, in timed sequence with the operation of the releasing, separating, forming, introducing, and shifting means.

9. The apparatus as defined in claim 8, further including a seam weaving arrangement including two machine halves which are identical except for being mirror images of one another; and wherein said seam loom shed forming means includes a Jacquard seam loom having a plurality of ties at least some of which are connected to the respective seam warp threads.

10. The apparatus as defined in claim 9, wherein said seam weaving arrangement further includes a frame interconnecting said machine halves; and wherein said positioning means for said end portions and for said seam warp threads includes a support, said frame being supported on said support for displacement in a predetermined direction corresponding to that of the advancement of the seam weaving operation and back.

11. The apparatus as defined in claim 9, wherein said separating means includes means for defining an aerodynamically configurated channel and an air nozzle aimed into said channel such that the gaseous medium stream emanating from said air nozzle entrains the respective seam weft thread for joint travel through the channel and toward the respectively associated seam loom shed.

12. The apparatus as defined in claim 9, wherein said separating means includes a needle separator including a rotatable shaft arranged at the point of emergence of the respective seam weft thread from the woven structure, at least one needle mounted on the shaft and extending substantially radially thereof, and means for rotating said shaft in timed sequence with operation of the seam weaving arrangement.

13. The apparatus as defined in claim 9, wherein said introducing means of each of said machine halves includes a floating arm mounted for movement in opposite directions across the respective seam loom shed, and a seam weft thread clamping arrangement mounted at the free end of the floating arm.

14. The apparatus as defined in claim 13, wherein said introducing means further includes a pivotally mounted two-armed rocking lever; wherein said floating arm is tubular and is connected to said rocking lever; and wherein said clamping arrangement includes at least one steel wire connected to the rocking lever and extending through, and beyond the free end of, the tubular floating arm, said steel wire having a bent portion extending out of the free end of the floating arm and movable in the longitudinal direction of the latter so as to clamp the respective seam weft thread on movement toward the free end of the floating arm and to release the same following the pivoting of said rocking lever.

15. The apparatus as defined in claim 9, wherein said shifting means includes a rotatably mounted needle roller having two substantially helically extending rows of flexible needles, the two rows being arranged opposite one another across the needle roller and the needles of such rows being so distributed that one of said rows extends along a clockwise and the other along a counterclockwise helical course.

16. The apparatus as defined in claim 9, wherein said shifting means includes a plurality of rectangularly bent needles, a guide bed mounting said needles in parallelism with one another and with freedom of longitudinal movement, a shifter having a curved groove and movable in opposite directions during the timed sequence of operation, said needles having a rear end portion received in the curved groove and following its course during the movement of the shifter, and a bent portion extending into the respective seam loom shed.

* * * * *